US009670696B2

(12) United States Patent
Chong

(10) Patent No.: US 9,670,696 B2
(45) Date of Patent: Jun. 6, 2017

(54) ELECTRONIC DEADBOLT

(71) Applicant: KWIKSET CORPORATION, Lake Forest, CA (US)

(72) Inventor: Gerald Chong, Irvine, CA (US)

(73) Assignee: Spectrum Brands, Inc., Middleton, WI (US)

( * ) Notice: Subject to any disclaimer, the term of this patent is extended or adjusted under 35 U.S.C. 154(b) by 25 days.

(21) Appl. No.: 14/189,782

(22) Filed: Feb. 25, 2014

(65) Prior Publication Data

US 2014/0250956 A1 Sep. 11, 2014

Related U.S. Application Data

(60) Provisional application No. 61/776,474, filed on Mar. 11, 2013.

(51) Int. Cl.

| | |
|---|---|
| ***E05B 47/00*** | (2006.01) |
| ***G07C 9/00*** | (2006.01) |
| ***E05B 47/02*** | (2006.01) |

(52) U.S. Cl.

CPC ..... *E05B 47/0012* (2013.01); *E05B 47/026* (2013.01); *G07C 9/00174* (2013.01);

(Continued)

(58) Field of Classification Search

CPC ..... G07C 9/0069; G07C 9/00817; G07C 9/00857; G07C 9/00904; G07C 9/00571; G07C 9/00896; E05B 47/00; E05B 47/0001; E05B 63/0056; E05B 2047/0086; E05B 17/042; Y10T 70/7107

USPC ..... 340/5.21, 5.2, 5.7, 5.61, 5.8, 5.22, 5.24, 340/5.25, 5.65; 70/277, 278.2, 278.3; 235/382

See application file for complete search history.

(56) References Cited

U.S. PATENT DOCUMENTS

| | | | |
|---|---|---|---|
| 5,841,361 | A | 11/1998 | Hoffman |
| 5,933,086 | A | 8/1999 | Tischendorf et al. |

(Continued)

FOREIGN PATENT DOCUMENTS

| | | |
|---|---|---|
| JP | 09264084 | 10/1997 |
| JP | 11303475 | 11/1999 |

(Continued)

OTHER PUBLICATIONS

International App. No. PCT/US2014/018435, International Preliminary Report on Patentability dated Sep. 24, 2015.

*Primary Examiner* — Mirza Alam

(74) *Attorney, Agent, or Firm* — Barnes & Thornburg LLP

(57) ABSTRACT

An electronic deadbolt assembly with a latch assembly having a bolt movable between an extended position and a retracted position. The deadbolt has an exterior assembly and an interior assembly. The exterior assembly has an electronic input device for entering a passcode and a wiring harness in electrical communication with the electronic input device. The interior assembly includes an electronic control assembly configured to move the bolt between the extended position and the retracted position responsive to an authorized passcode being entered in the electronic input device. The interior assembly has an electrical connector in electrical communication with the electronic control assembly that is configured to be connected with the connector on the exterior assembly.

15 Claims, 22 Drawing Sheets

(52) U.S. Cl.
CPC .... *G07C 9/00944* (2013.01); *E05B 2047/002* (2013.01); *E05B 2047/0091* (2013.01); *G07C 9/0069* (2013.01); *G07C 9/00817* (2013.01); *Y10T 70/70* (2015.04); *Y10T 70/7068* (2015.04)

(56) References Cited

U.S. PATENT DOCUMENTS

| | | | | |
|---|---|---|---|---|
| 5,974,367 | A | 10/1999 | Bianco | |
| 6,064,316 | A | 5/2000 | Glick et al. | |
| 6,745,602 | B2 | 6/2004 | Nakasone et al. | |
| 6,975,202 | B1 * | 12/2005 | Rodriguez | G07C 9/00103 340/10.1 |
| 7,373,795 | B2 | 5/2008 | Kilbourne | |
| 8,033,147 | B2 | 10/2011 | Lie-Nielsen et al. | |
| 8,079,240 | B2 | 12/2011 | Brown | |
| 8,141,400 | B2 | 3/2012 | Sorensen et al. | |
| 8,176,761 | B2 | 5/2012 | Sorensen et al. | |
| 8,272,241 | B2 | 9/2012 | Brown | |
| 8,339,239 | B2 | 12/2012 | Kirkjan | |
| 2003/0132829 | A1 | 7/2003 | Frolov | |
| 2003/0209043 | A1 | 11/2003 | Yeh et al. | |
| 2005/0046202 | A1 | 3/2005 | Rodriguez et al. | |
| 2006/0117819 | A1 | 6/2006 | Kilbourne | |
| 2008/0236214 | A1 | 10/2008 | Han | |
| 2009/0193859 | A1 * | 8/2009 | Kwon | E05B 47/026 70/91 |
| 2010/0139342 | A1 | 6/2010 | Lie-Nielsen et al. | |
| 2010/0257906 | A1 | 10/2010 | Sorensen et al. | |
| 2010/0294008 | A1 * | 11/2010 | Bogdanov | E05B 47/0692 70/277 |
| 2011/0252843 | A1 * | 10/2011 | Sumcad | E05B 47/00 70/91 |
| 2011/0259059 | A1 | 10/2011 | Wu et al. | |
| 2012/0055213 | A1 * | 3/2012 | Sorensen | E05B 47/068 70/279.1 |
| 2012/0073338 | A1 | 3/2012 | Mohla | |
| 2012/0086548 | A1 * | 4/2012 | Kirkjan | G07C 9/00309 340/5.25 |
| 2013/0008213 | A1 * | 1/2013 | Brown | E05B 47/00 70/264 |

FOREIGN PATENT DOCUMENTS

| | | |
|---|---|---|
| JP | 2007107225 | 4/2007 |
| JP | 2011226121 | 11/2011 |
| KR | 2001019650 | 3/2001 |
| KR | 2001084987 | 9/2001 |
| WO | WO 2012/177609 A1 | 12/2012 |

* cited by examiner

ELECTRONIC DEADBOLT

RELATED APPLICATIONS

This application claims the benefit of U.S. Provisional Application Ser. No. 61/776,474, filed Mar. 11, 2013, entitled "Electronic Deadbolt" which is hereby incorporated by reference in its entirety.

TECHNICAL FIELD

This disclosure relates generally to electro-mechanical locks; in particular, this disclosure relates to an electronic deadbolt with a compact size that can be easily installed.

BACKGROUND

Electronic deadbolts are well known. Indeed, electronic deadbolts have become increasingly popular for securing access in both residential and commercial settings. Although installation of electronic deadbolts is generally a straightforward task, problems can arise during installation. For example, a wiring harness of the exterior assembly is typically required to be passed through a bore in the door for connection to an interior assembly. In some cases, this can lead to any excess wires from the wiring harness becoming pinched. The electrical connection between the exterior assembly and the interior assembly can also be somewhat difficult in some situations.

With an electronic deadbolt installed, the ability to electrically control the lock can be convenient. From an aesthetic standpoint, however, electronic deadbolts tend to be larger than corresponding mechanical deadbolt locks. Depending on the circumstances, a deadbolt with a more compact size can be aesthetically desirable. Therefore, there exists a need for an electronic deadbolt that can be easily installed and has a compact size.

SUMMARY

This disclosure relates to an electronic deadbolt assembly. According to one aspect, the disclosure provides an electronic deadbolt assembly with a latch assembly having a bolt movable between an extended position and a retracted position. The deadbolt has an exterior assembly and an interior assembly. The exterior assembly has an electronic input device for entering a passcode and a wiring harness in electrical communication with the electronic input device. The interior assembly includes an electronic control assembly configured to move the bolt between the extended position and the retracted position responsive to an authorized passcode being entered in the electronic input device. The interior assembly has an electrical connector in electrical communication with the electronic control assembly that is configured to be connected with the connector on the exterior assembly. In some cases, the electrical connector of the interior assembly extends out of the interior assembly for easier access during installation. In some embodiments, the interior assembly includes a cavity dimensioned to receive at least a portion of the wiring harness to reduce any pinching of the wires between components of the deadbolt assembly. In some embodiments, the electronic deadbolt assembly includes a daughter board with an antenna electrically connected to the main board. The electronic control assembly may include a transmission with a gear train. The main board may be positioned between the interior cover and the gear train, so as to be a front loading main board.

According to another aspect, the disclosure provides an electronic deadbolt assembly comprising a latch assembly, an exterior assembly, an interior assembly, and a mounting bracket. The latch assembly may have a bolt movable between an extended position and a retracted position. The exterior assembly may include an electronic input device for entering a passcode, wherein the exterior assembly includes a wiring harness in electrical communication with the electronic input device. The interior assembly may include an electronic control assembly configured to move the bolt between the extended position and the retracted position responsive to an authorized passcode being entered in the electronic input device. The mounting bracket may include a plurality of tabs extending transversely from a plate portion of the mounting bracket, wherein the interior assembly includes a plurality of recesses dimensioned to receive the tabs in the mounting bracket. In some cases the electronic deadbolt assembly includes a transmission with a gear train having more than two gears.

In some cases, the electronic deadbolt assembly includes an interior cover housing the interior assembly, a turnpiece extending through an opening of the interior cover, and a stem connected to both the turnpiece and an interior driver. The stem may be dimensioned to receive the turnpiece. The interior driver may be configured to manually move the bolt between an extended and retracted position.

According to a further aspect, this disclosure provides an electronic deadbolt with a latch assembly including a bolt movable between an extended position and a retracted position. The deadbolt includes an electronic input device configured to receive an input data and a motor configured to move the bolt between the extended and retracted positions. A controller is provided for controlling actuation of the motor responsive to input data received from the electronic input device. In some embodiments, the controller is switchable between a single user mode and a master mode. In the single user mode, the controller actuates the motor responsive to an authenticated user code while in the master mode the controller actuates the motor responsive to an authenticated master code and an authenticated user code. In some embodiments, the controller is configured to switch between the master mode and the single user mode responsive to input data received from the electronic input device. In some cases, the controller is configured to add and/or delete authenticated user code(s) responsive to input data received from the electronic input device in the master mode.

According to another aspect, the disclosure provides a method of installing an electronic deadbolt. The method includes the step of attaching a mounting plate to an interior side of a door. An electrical connector of a wiring harness of an electronic deadbolt's exterior assembly is moved through a bore in a door. The electrical connector extending through the bore is connected with an electrical connector of the electronic deadbolt's interior assembly. Typically, the electrical connector of the electronic deadbolt's interior assembly extends out a rear portion of the interior assembly for easier installation.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
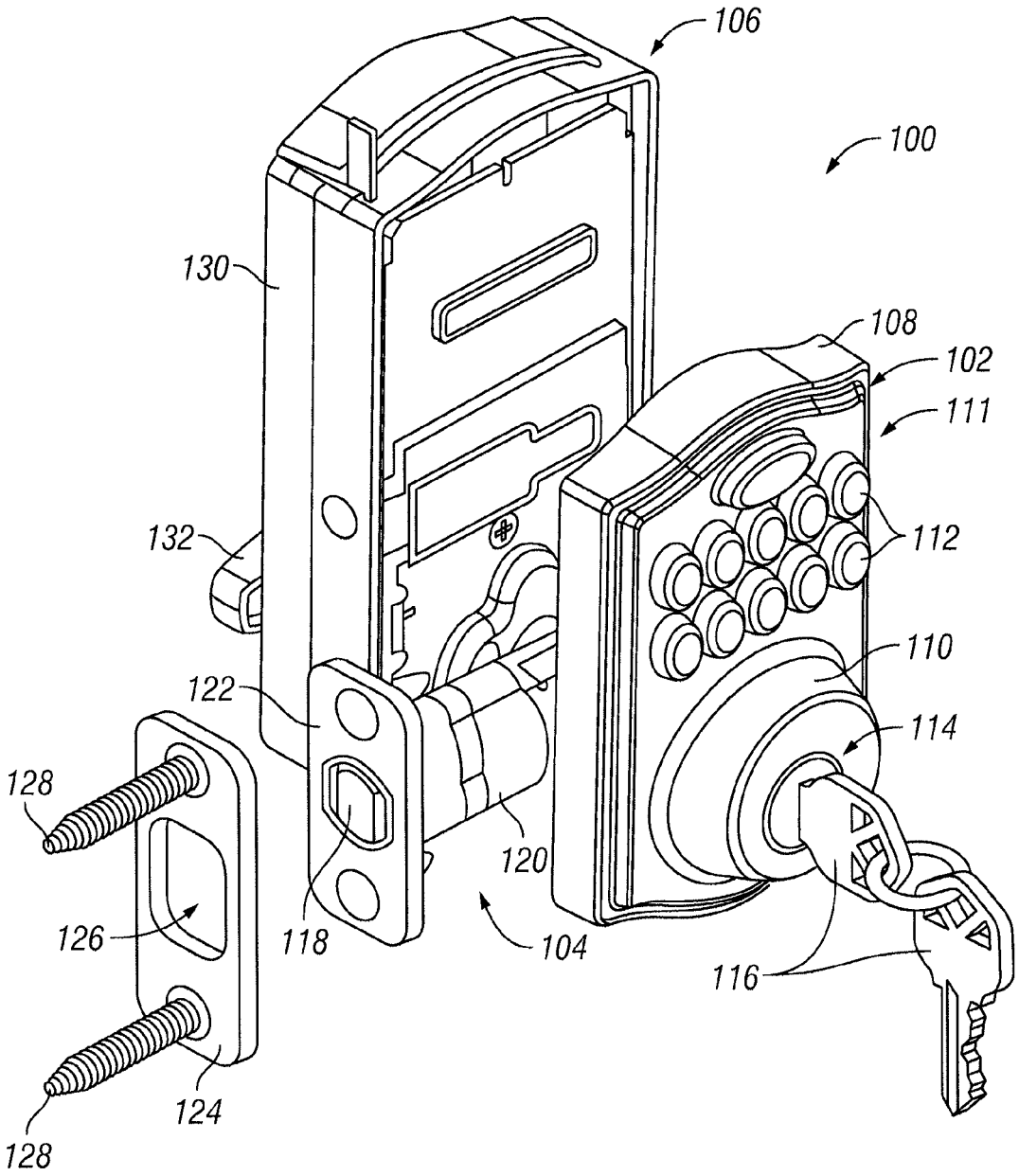
FIG. 1 is a perspective view of the deadbolt assembly according to one embodiment.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

FIG. 1 shows an electronic deadbolt assembly 100 according to one embodiment of the disclosure. The term "electronic deadbolt" is broadly intended to encompass electro-mechanical locks with a bolt that is movable between a locked and unlocked position electronically and/or mechanically, including but not limited to single cylinder, double cylinder, and vertical deadbolts. In the example shown, the electronic deadbolt assembly 100 includes an exterior assembly 102, a latch assembly 104, and an interior assembly 106. Typically, the exterior assembly 102 is mounted on the outside of a door 10 (the door is visible in FIGS. 15 and 16), while the interior assembly 104 is mounted inside the door 10. The latch assembly 104 is mounted in a bore formed in the door 10. The term "outside" is broadly used to mean an area outside a door and "inside" is also broadly used to denote an area inside a door. With an exterior entry door, for example, the exterior assembly 102 may be mounted outside a building, while the interior assembly 106 may be mounted inside the building. With an interior door, the exterior assembly may be mounted inside a building, but outside a room secured by the deadbolt assembly 100; the interior assembly may be mounted into the secured room. The deadbolt assembly 100 is applicable to both interior and exterior doors.

In the example shown, the exterior assembly 102 has an exterior rose 108 that houses the exterior assembly 102. As shown, the exterior rose 108 has a decorative rectangular shape, but round, square, and other shapes for the exterior rose 108 are within the scope of the disclosure. A keypad 111 with a plurality of buttons 112 extend through the exterior rose 108 in the example shown. The buttons 112 may be used to enter a passcode for unlocking the deadbolt assembly 100 or otherwise control operation. Although a keypad 111 with buttons 112 is shown for purposes of example, other input devices could be used, including but not limited to a touch screen, biometric sensor, microphone, etc. A cylinder guard 110 extends from the exterior rose 108 to protect and reinforce a mechanical locking assembly 114. In the example shown, the cylinder guard 110 is formed integral with the exterior rose 108, but could be a separate component. A mechanical key 116 may be inserted into the mechanical lock assembly 114 to mechanically unlock the deadbolt assembly 100. Accordingly, in the embodiment shown, the exterior assembly 100 may be used to unlock the deadbolt assembly 100 either electronically using the keypad 111, or mechanically using a mechanical key 116.

The latch assembly 104 is disposed in a core in the door 10 and may be actuated manually by the mechanical lock assembly 114, or electronically using the keypad 111 to extend and retract a bolt 118. The bolt 118 moves linearly in and out of a sleeve 120. When the bolt 118 is retracted, an end of the bolt 118 is generally flush with a base plate 122. When the bolt 118 is extended, the bolt 118 protrudes through an edge bore in the door 10 into an opening 126 of a strike plate 124, which is positioned in a jamb adjacent the door 10. As is typical, the strike plate 124 is attached to the jamb using fasteners 128.

The interior assembly 106 includes an interior cover 130 that houses internal components of the internal assembly 106 as explained below. A turnpiece 132 may be rotated by a user to manually extend and retract the bolt 118.

Figure 2:
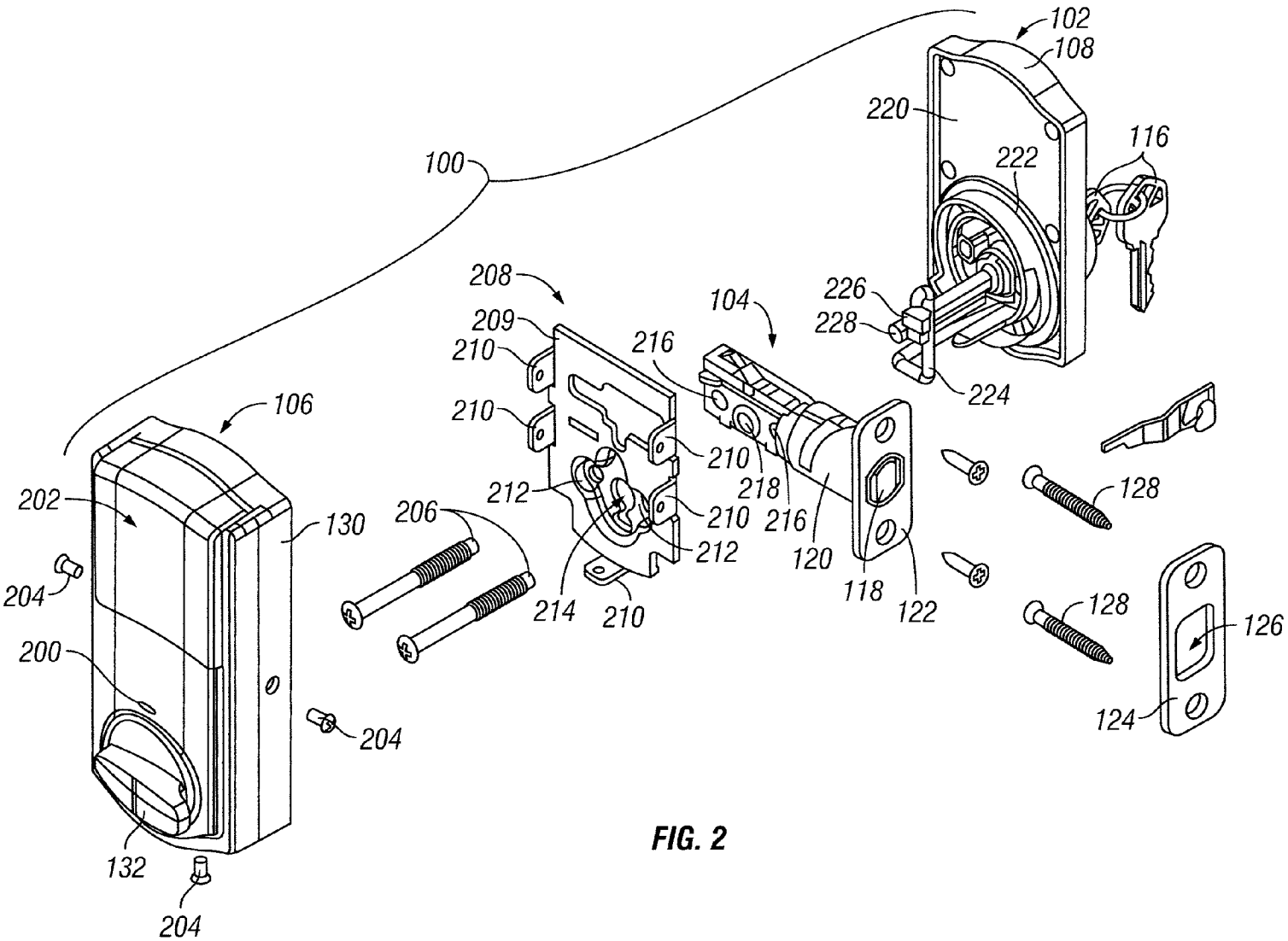
FIG. 2 is an exploded view of the deadbolt assembly according to the embodiment shown in FIG. 1.

FIG. 2 is an exploded view of the deadbolt assembly 100 according to the embodiment shown in FIG. 1. As seen in this example, the interior assembly 106 includes a light 200 that provides status information regarding the deadbolt assembly 100. For example, the light 200 may indicate if the bolt 118 is unlocked, such as by illuminating a green color and could indicate if the bolt 118 is locked, such as by illuminating a red color. These are merely examples of possible status information that could be indicated by the light 200, but other possibilities exist. In the embodiment shown, the interior cover 130 includes a radio frequency ("RF") transparent portion 202, which allows RF signals to be transmitted out of the interior assembly 106. For example, the deadbolt assembly 100 may wirelessly communicate with other electronic devices, which could allow the deadbolt assembly to be remotely controlled, such as using a mobile device. In one embodiment, the RF transparent portion 102 could be made of Lexan® available from SABIC Innovative Plastics of the Netherlands. In this example, a plurality of fasteners 204 connect the interior assembly 106 together.

A mounting plate 208 is mounted to an interior portion of a door using fasteners 206. In this example, the mounting plate includes a plate portion 209 defining openings 212 through which the fasteners 206 extend to be attached with threaded interior threads of openings 216 in the latch assembly 104. As shown, the mounting plate 208 includes tabs 210 that extend from the plate portion for connecting the interior assembly 106 to the door 10. A pass-through 214 defined in the plate portion 209 is dimensioned to receive a wiring harness 224 with an exterior connector 226 and torque blade 228 from the exterior assembly 102 that extends through a spindle drive 218 on the latch assembly 104. As explained below, rotation of the torque blade 228 within the spindle drive 218 in a first direction causes the bolt 118 to extend and rotation of the torque blade 228 in the opposing direction causes the bolt 118 to retract. For example, the torque blade 228 could be manually rotated using the turnpiece 132, or mechanical lock assembly 114, or electronically controlled with a motor responsive to a user entering an authorized pass code using the keypad 111 (discussed below) to extend/retract the bolt 118. As shown, the exterior assembly 102 includes an adaptor 222 that is dimensioned to be received by the bore in the door that extends from a back plate 220.

Figure 3:
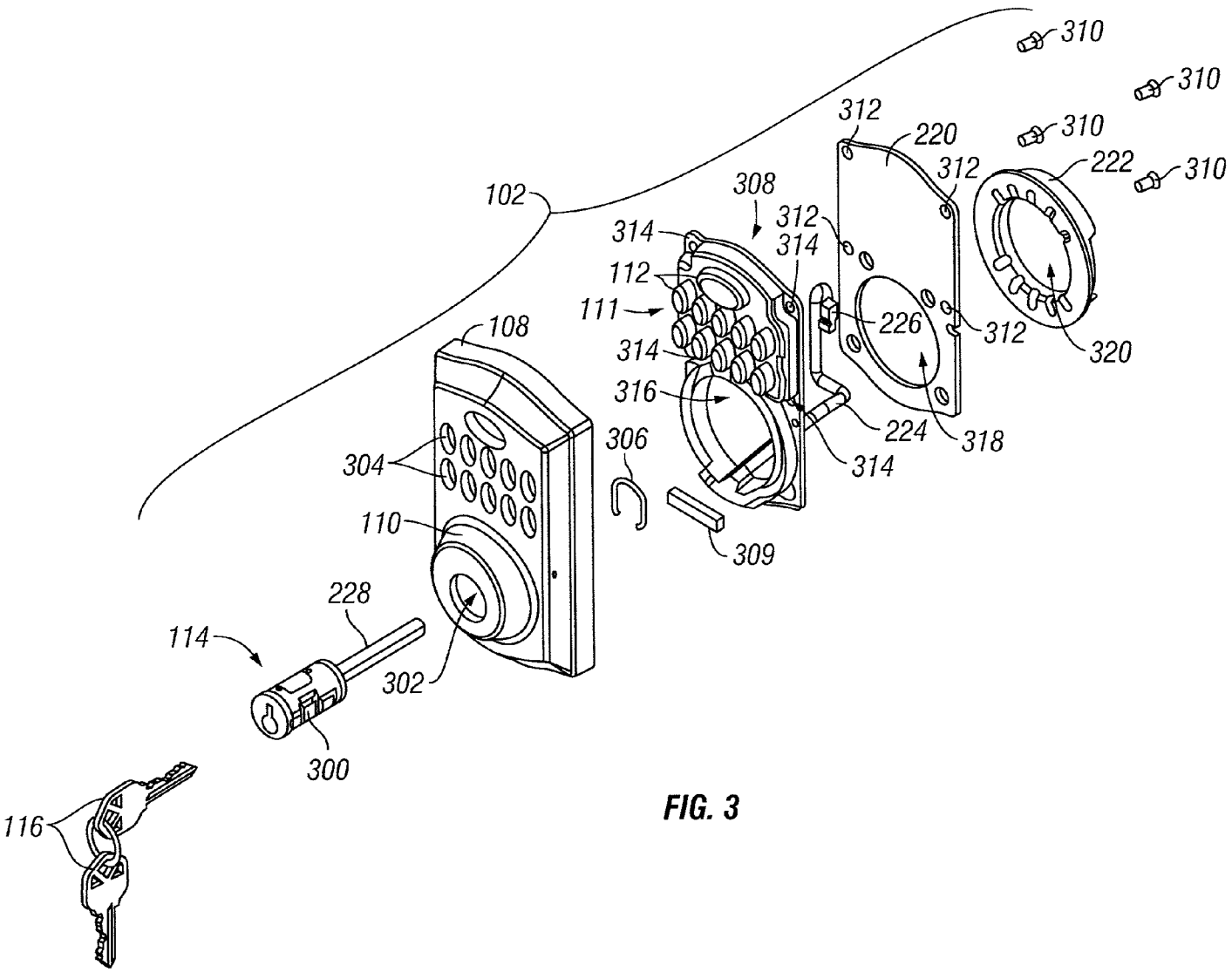
FIG. 3 is an exploded view of the exterior assembly according to the embodiment shown in FIG. 1.

FIG. 3 is an exploded view of the exterior assembly 102 according to the embodiment shown in FIG. 1. As shown, a mechanical lock assembly 114 with a lock cylinder 300 extends into an opening 302 defined in the cylinder guard 110. To mechanically lock/unlock the bolt 118 with the mechanical lock assembly 114, a user would insert a mechanical key 116 into the lock cylinder 300 and rotate the lock cylinder 300, which rotates the torque blade 228. In the example shown, the rose 108 includes a plurality of holes 304 aligned to receive the buttons 112 of the keypad 111. A clip 306 is provided to secure the lock cylinder 300 to the exterior rose 108. The buttons 112 extend from a circuit board 308 that transmits electrical signals based on user actuation of the keypad 111 to a controller in the interior assembly 106 using a wiring harness 224. In some cases, a wedge 309 may be provided to fill and dampen any gap between the exterior rose 108 and the circuit board 308. In this example, a plurality of fasteners 310 secure the back plate 220 and circuit board 308 to the rose 108. As shown, holes 312 in the back plate 220 are aligned with holes 314 in the circuit board 308 and fasteners 310 extending therethrough. In the embodiment shown, the circuit board 308 includes an opening 316 that is aligned with an opening 318 in the back plate 220, which aligns with an opening 320 in the adaptor 222 so that the torque blade 228 and wiring harness 224 may extend therethrough.

Figure 4:
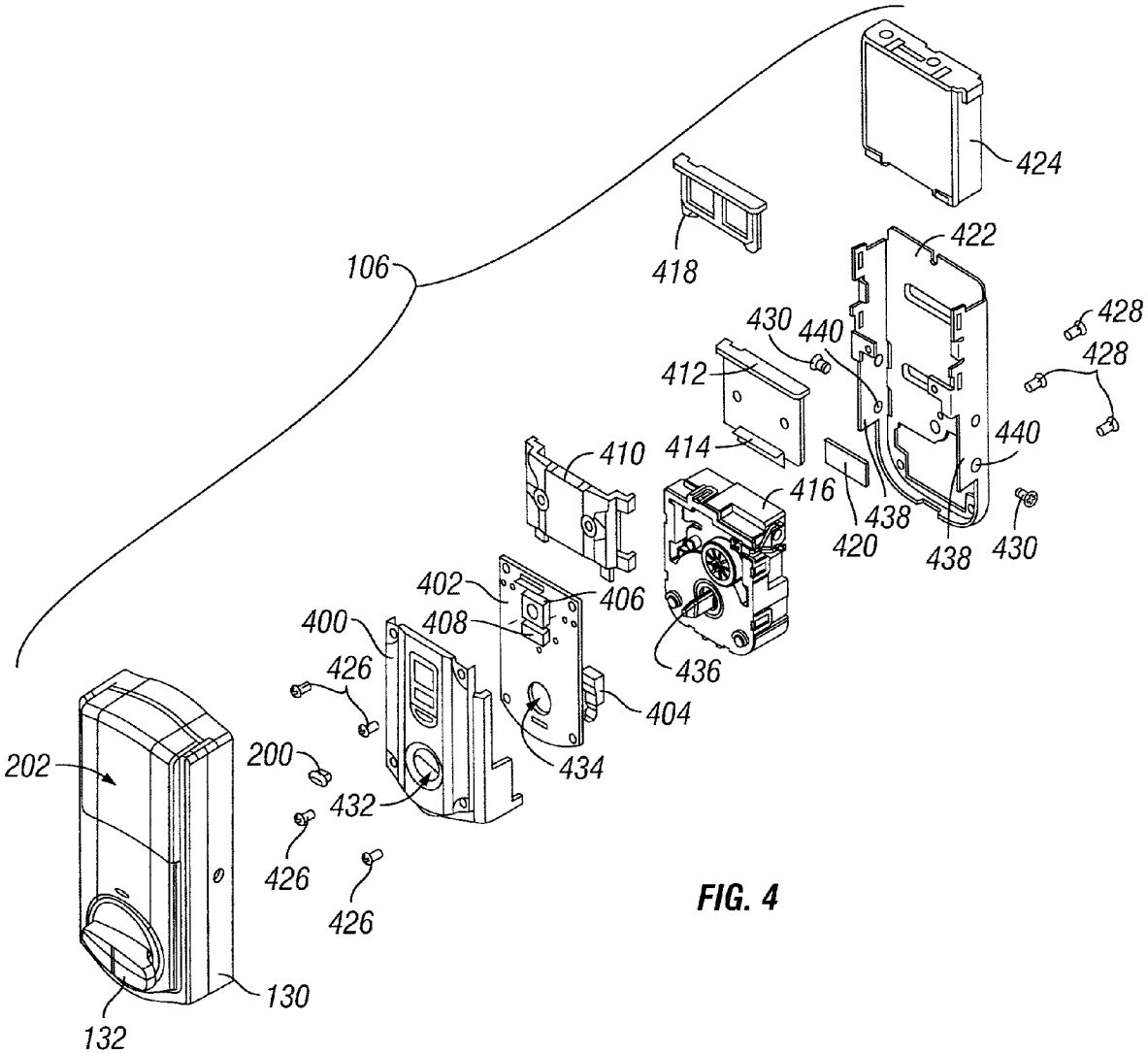
FIG. 4 is an exploded view of the interior assembly according to the embodiment shown in FIG. 1.

FIG. 4 is an exploded view of the interior assembly 106. In the example shown, the interior assembly 106 includes a PCB cover 400 that is connected with a main board 402, which is a circuit board having a controller or processor that is programmed for one or more of the functions described herein. In this example, the main board 102 is in electrical communication with a connector 404 that is configured to be connected with the connector 226 from the exterior assembly 102. As shown, the main board 402 includes a button 406 that allows the controller to be programmed with various modes and be customized by the user. A bank of switches 408 allows the user to customize settings for the controller.

In this example, the PCB cover 400 is also connected to a daughter board holder 410 that secures a daughter board 412. The daughter board 412 may include an antenna, such as a Zigbee antenna for transmitting radio frequency signals to other electronic devices. The daughter board 412 connects to the main board 402 using connectors 414 so that the daughter board 412 is in electrical communication with the main board 402. In the example shown, the PCB cover 400 includes an opening 432 that is alignable with an opening 434 in the main board 402 so that a stem 436 may pass therethrough. The stem 436 may be connected to the turnpiece 132 so that rotation of the turnpiece 132 rotates the stem 436.

In the embodiment shown, a transmission box 416 is also attached to the PCB cover 400. In the example shown, a plurality of fasteners 426 attaches to the main board, daughter board holder 410, and transmission box 416 to the PCB cover 400. In some cases, a vibration pad 420 may be provided to dampen any vibrations caused by the transmission box 416. These components are connected with a back plate 422 using tabs on the daughter board holder 410 in the example shown.

The back plate 422 houses a battery holder assembly 424, which is configured to hold a plurality of batteries for providing electrical power to electronic components in the deadbolt assembly 100. In the embodiment shown, the back plate 422 includes an extension 438 with holes 440 alignable with holes in tabs 210 of the mounting plate 208. Fasteners 430 may be used to secure these components to the mounting plate 208.

Figure 5:
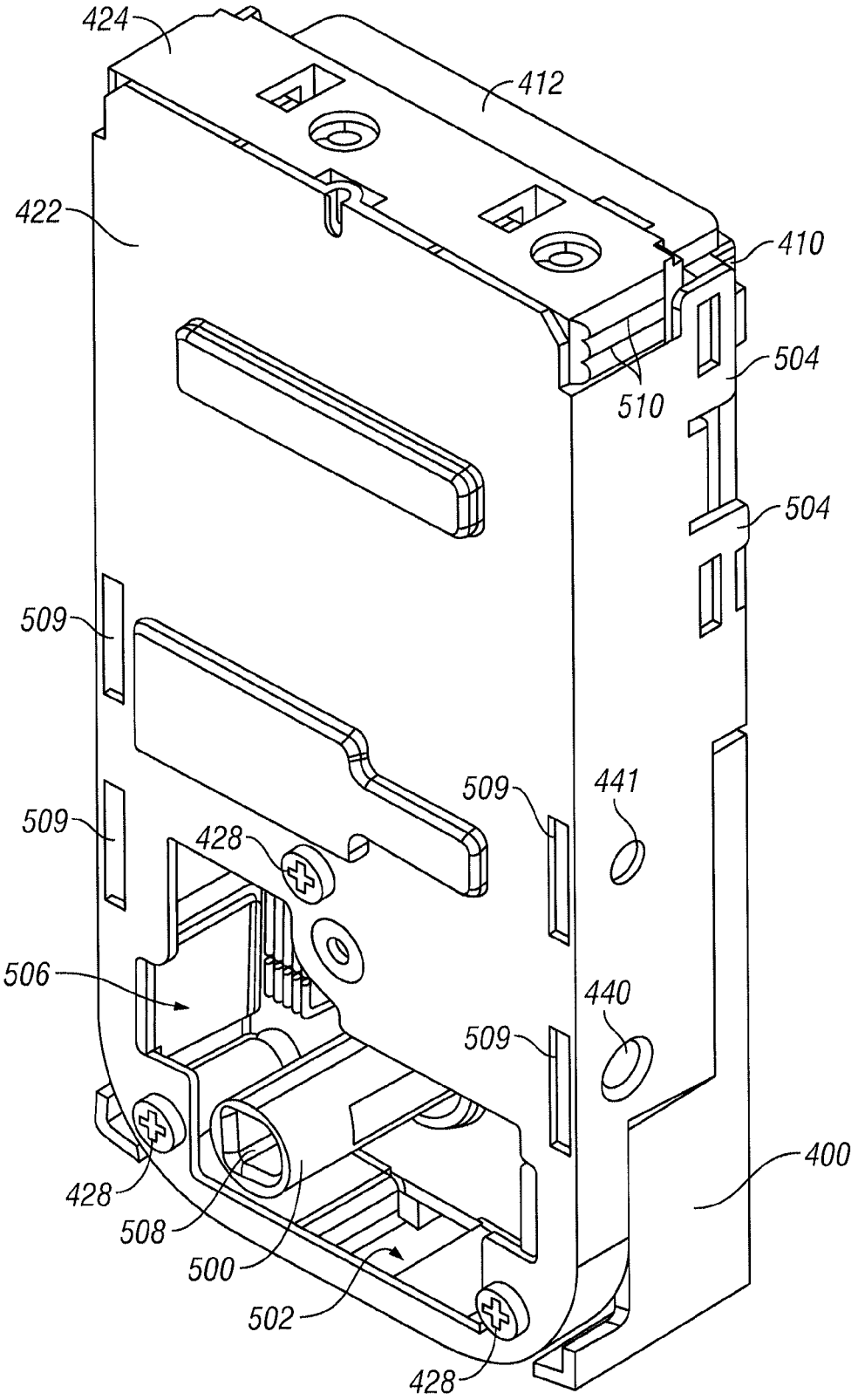
FIG. 5 is a rear perspective view of the interior assembly without the cover attached.

FIG. 5 is a rear perspective view of the interior assembly 106 without the interior cover 130 connected. In this view, a connection between the back plate 422 and the daughter board holder 420 can be seen. In the embodiment shown, the back plate 422 includes a detent portion 504 that receives a flange extending from the daughter board holder 410. In this example, a cavity 506 is formed in the rear portion of the interior assembly 106 that is dimensioned to hold any excess portion of the wire harness 224 to prevent any pinching thereof. An interior driver 500 extends from the stem 436 and includes an opening 508 that is dimensioned to receive the torque blade 228. Accordingly, rotation of the turnpiece 132 rotates the stem 436 which causes the torque blade 228 to rotate. The rotation of the torque blade 228 actuates the spindle drive 218 in the latch assembly 104 to lock or unlock the deadbolt assembly 100. Accordingly, a user may manually lock or unlock the deadbolt assembly 100 by rotating the turnpiece 132. In the embodiment shown, the back plate 422 includes an opening 502 through which the connector 404 may extend out through the cavity 506 to provide easy access for a connection with the exterior connector 226.

In this view, a threaded opening 440 is defined in the back plate 422 to receive the fasteners 430 (FIG. 4). In the example shown, the back plate 422 defines slots 509 that are arranged and dimensioned to receive tabs 210 in the mounting plate 208. With the tabs 210 extending into slots 509, this aligns holes in tabs 210 with opening 440 for fasteners 430 to extend therethrough. In this example, fasteners 430 and 204 extend into openings 440 and 441, respectively, in back plate 422 and through holes in tabs 210 of mounting plate 208. With the interior cover 130 placed over the interior assembly, holes 441 in the back plate align for fasteners 204 to extend through the tabs 210 in the mounting plate 208 (see FIGS. 8-10). Openings for the fasteners 428 can also be seen. In the example shown, the battery holder assembly 424 includes a plurality of ridges 510 to aide the user in removing the battery holder assembly 424 from the interior assembly 106 when the batteries need to be replaced.

Figure 6:
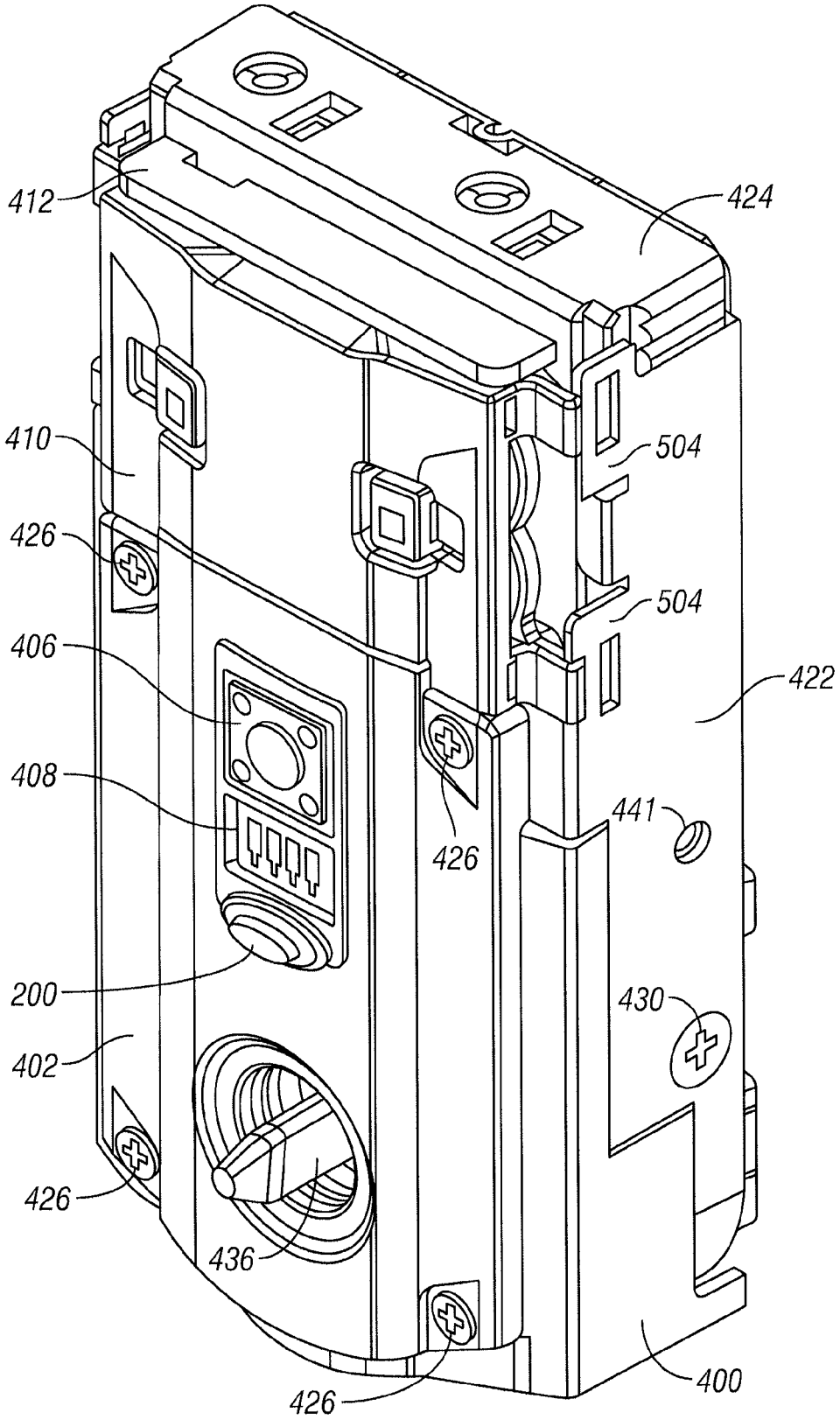
FIG. 6 is a front perspective view of the interior assembly without the cover attached.

FIG. 6 is a front perspective view of the interior assembly 106 without the interior cover 130 attached. In the example shown, the stem 436 can be seen extending through the main board 402. As shown, the stem 436 has an approximately triangular cross-section. This shape for the stem 436 allows the attachment with the turnpiece 132 to self-align to allow easier installation for the user.

Figure 7:
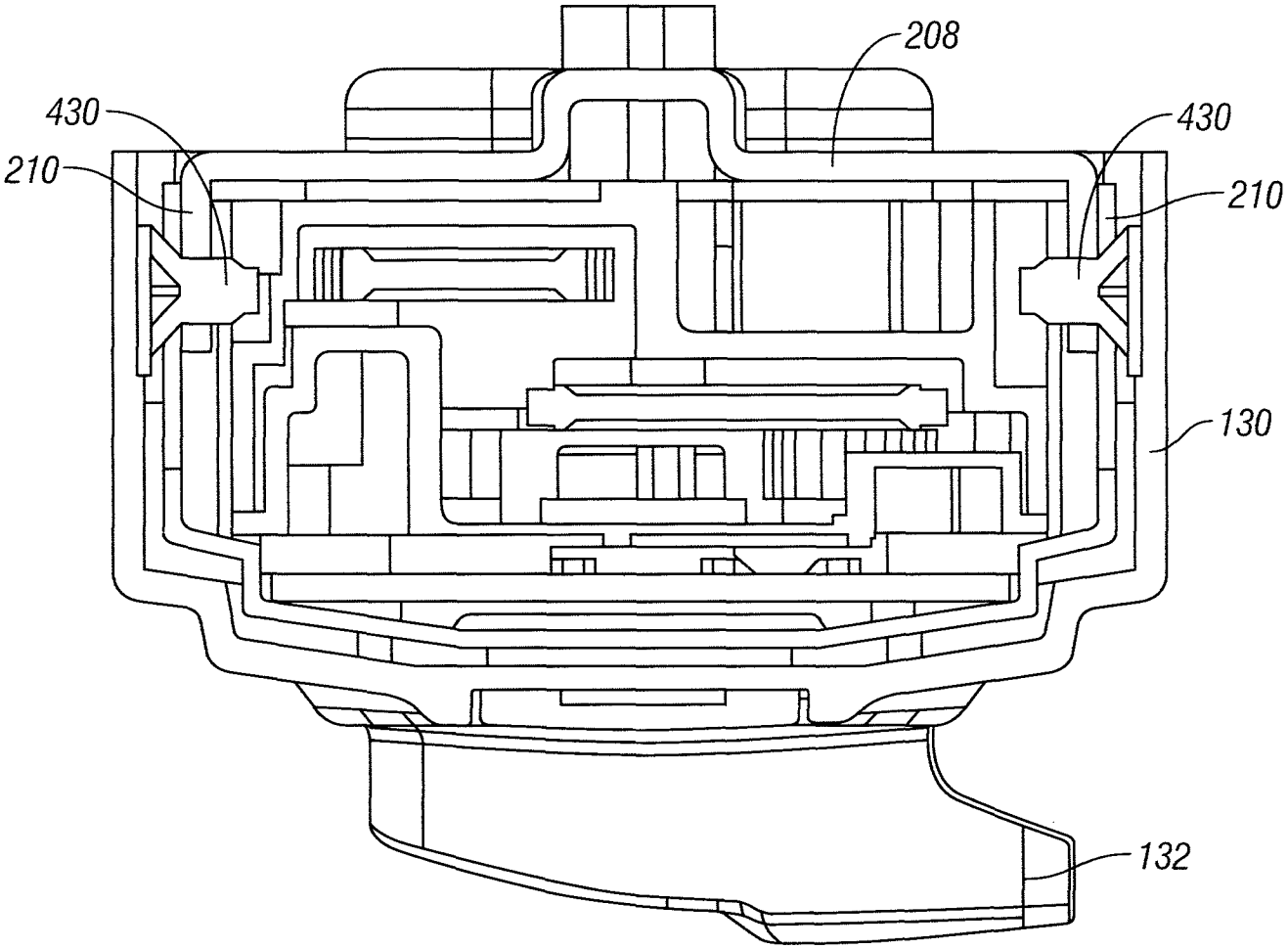
FIG. 7 is a top cross-sectional view of the interior assembly.
Figure 10:
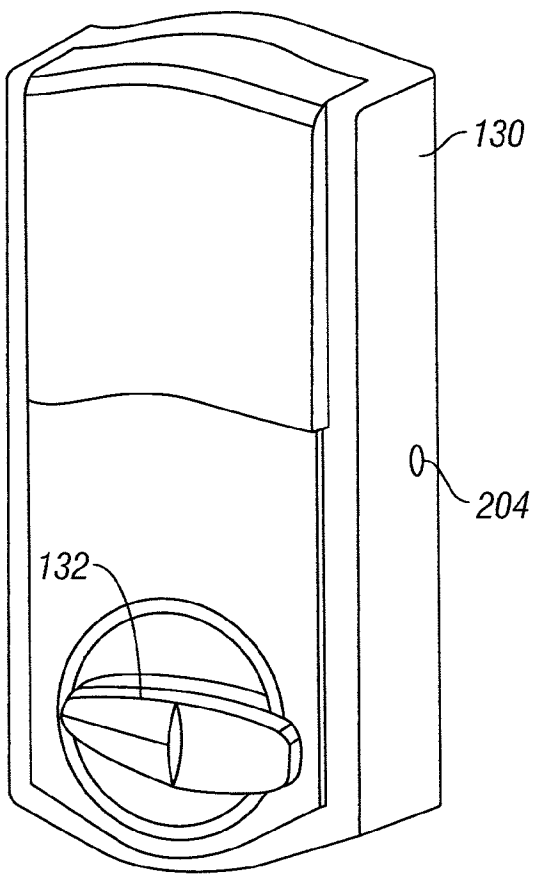
FIG. 10 is a right side perspective view of the interior assembly.
Figure 9:
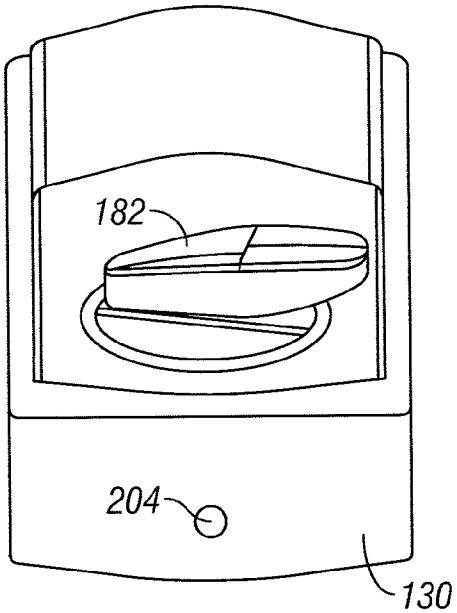
FIG. 9 is a bottom perspective view of the interior assembly.
Figure 8:
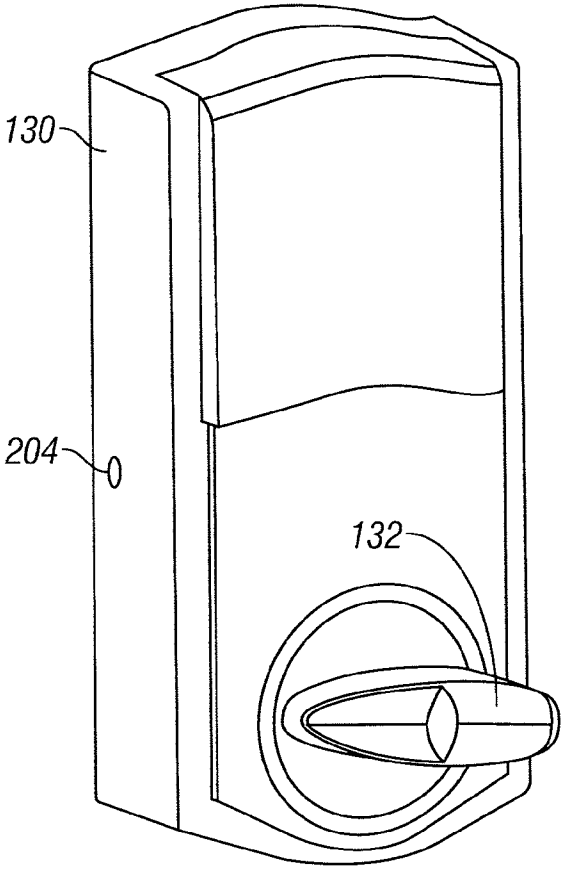
FIG. 8 is a left side perspective view of the interior assembly.

FIG. 7 is a cross-sectional view cut along a horizontal axis to show the connection of the interior assembly 106 to the mounting plate 208. As can be seen, the fasteners 430 connect to the back plate 422 of the interior assembly without the interior cover 130 to the tabs 210 on the mounting plate 208. These fasteners 430 may be low profile and extend inside of the interior cover 130. The fasteners 204 then attach the interior cover 130 to the back plate 422 and mounting plate 208. FIGS. 8-10 show this connection of fasteners 204 to the interior cover 130. Connecting the interior assembly 106 using fasteners that are connected to tabs transverse to the door takes up less space for a smaller footprint.

Figure 11:
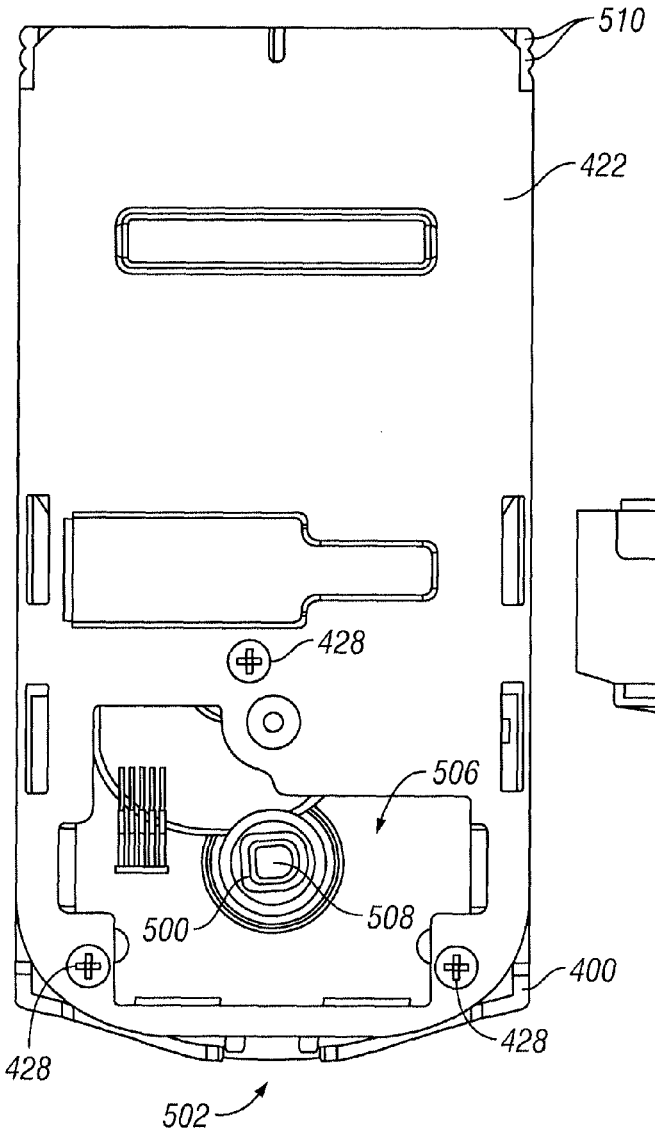
FIG. 11 is a rear view of the interior assembly without the cover attached.
Figure 12:
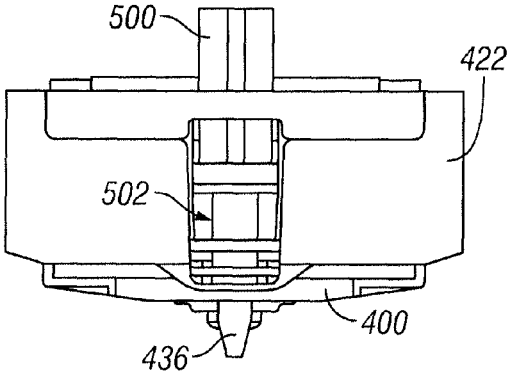
FIG. 12 is a bottom view of the interior assembly without the cover attached.
Figure 13:
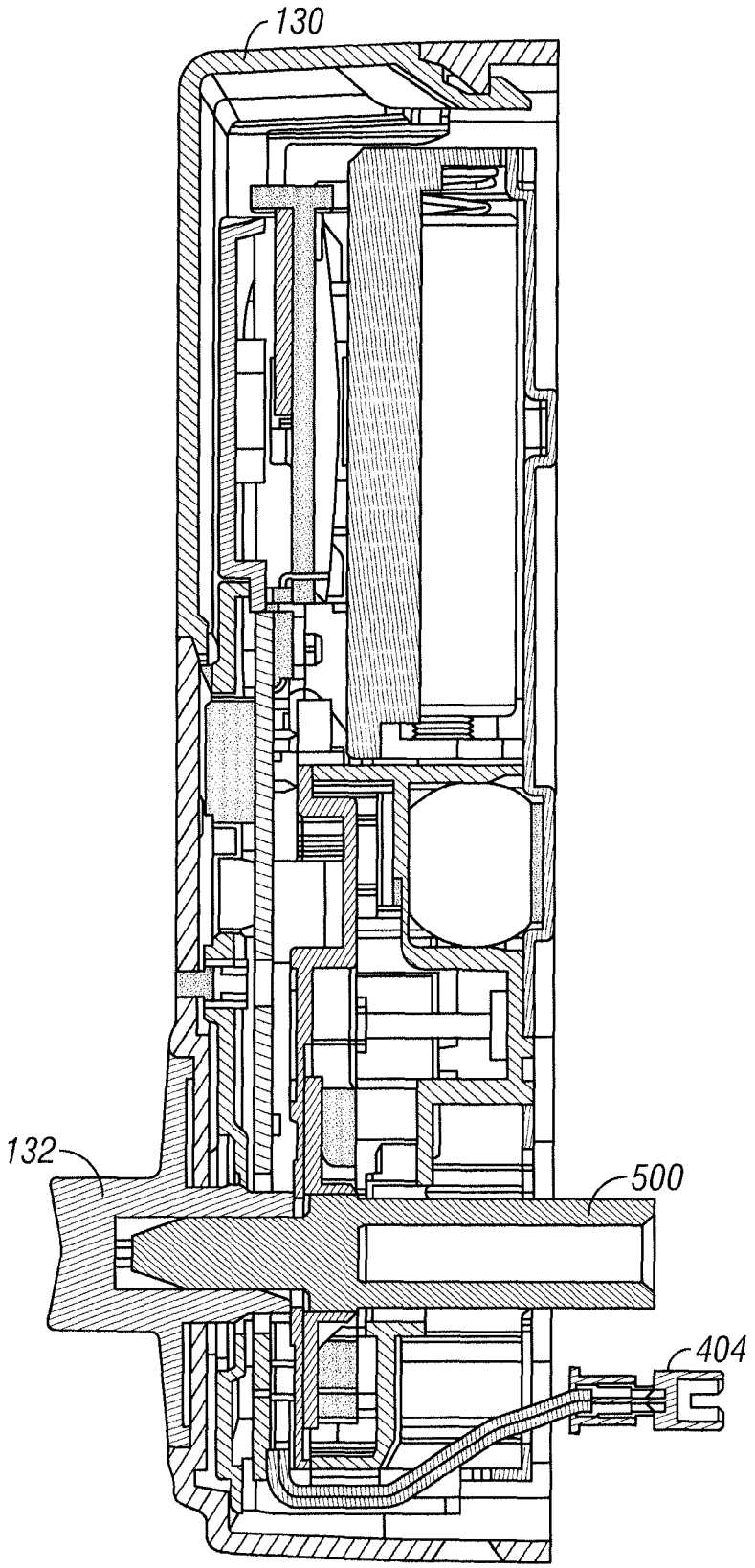
FIG. 13 is a side cross-sectional view of a portion of the interior assembly showing an electrical connector extending out the back of the interior assembly.
Figure 14:
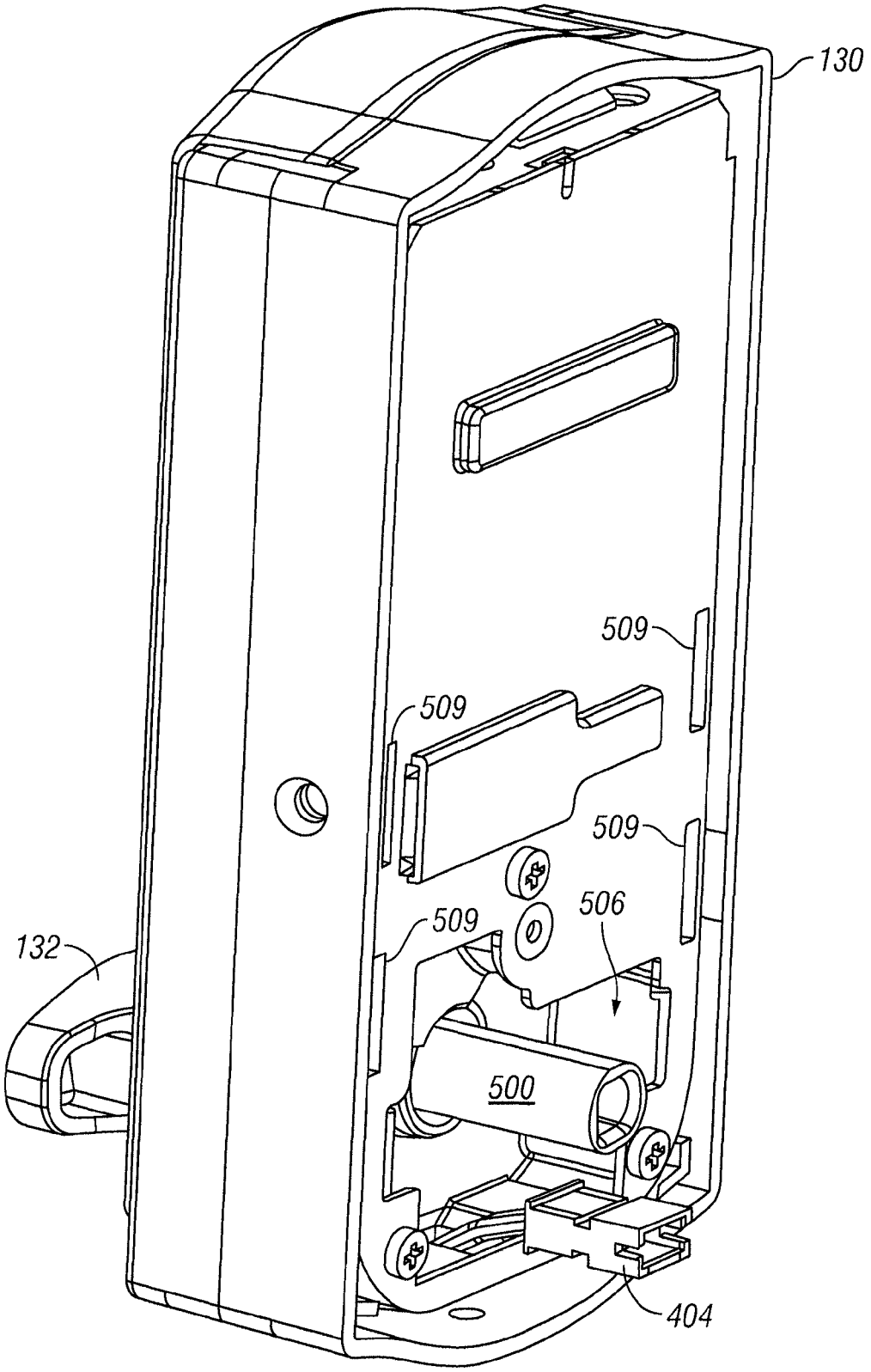
FIG. 14 is a detailed rear perspective view of a portion of the interior assembly showing an electrical connector extending out the back of the interior assembly.

FIGS. 11 and 12 show a rear view and bottom view of the interior assembly 106 without the interior cover 130 connected, respectively. In this example, the back plate 422 defines an opening 502 through which the interior connector 404 extends from the main board 402 and then out the opening 506 for attachment to the external connector 226. The interior connector 404 allows the connection to the exterior connector 226 to be remote from the main board 402, this allows for a more compact assembly in which the wiring harness 224 does not need to be connected directly to the main board 402. FIGS. 13 and 14 show additional views of the interior connector 404 extending out of the cavity 506 for connection to the wiring harness 224 via the exterior connector 226.

Figure 15:
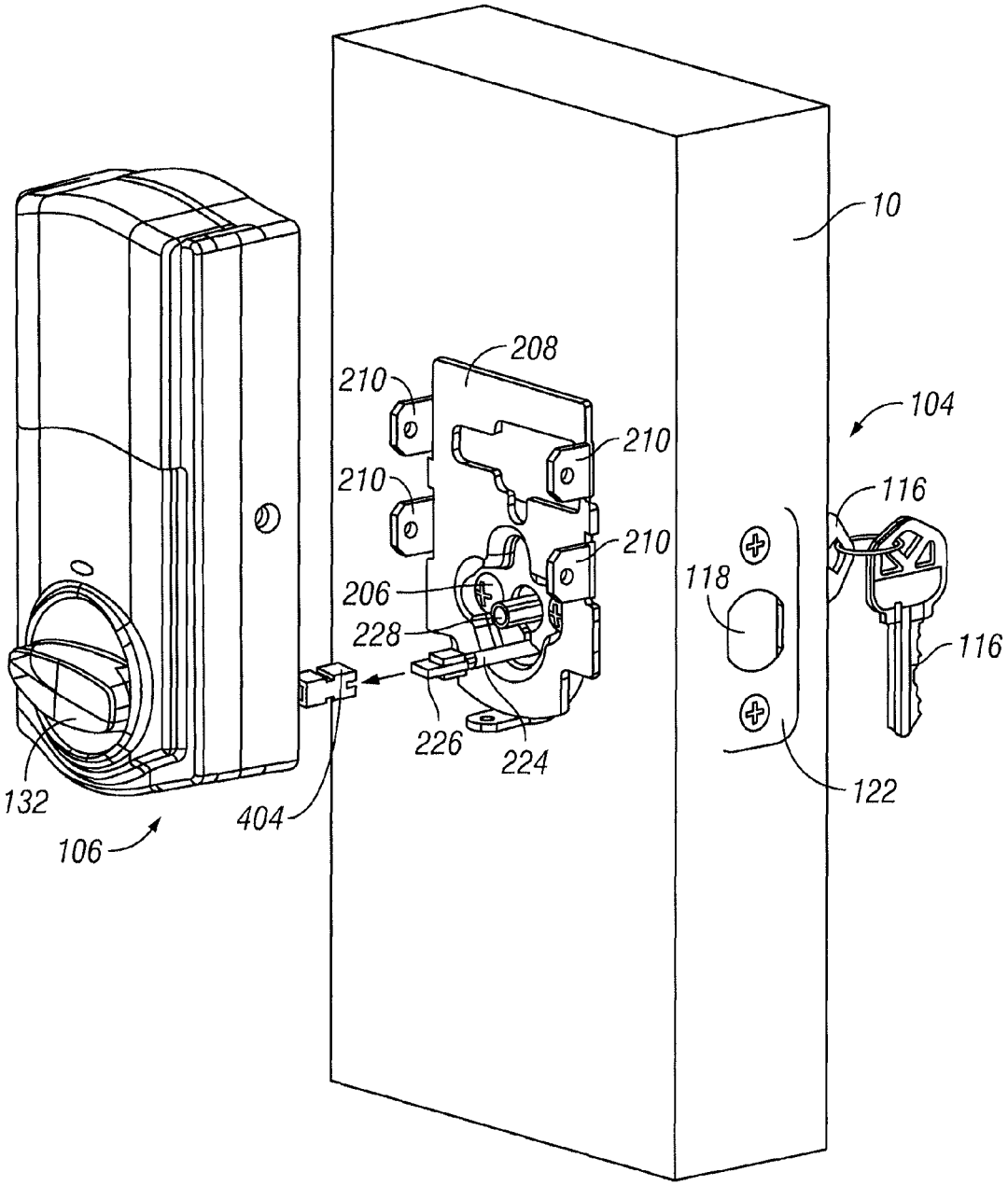
FIGS. 15-16 are exploded views of the deadbolt assembly during installation showing an electrical connection to be made between the exterior assembly and the interior assembly.
Figure 16:
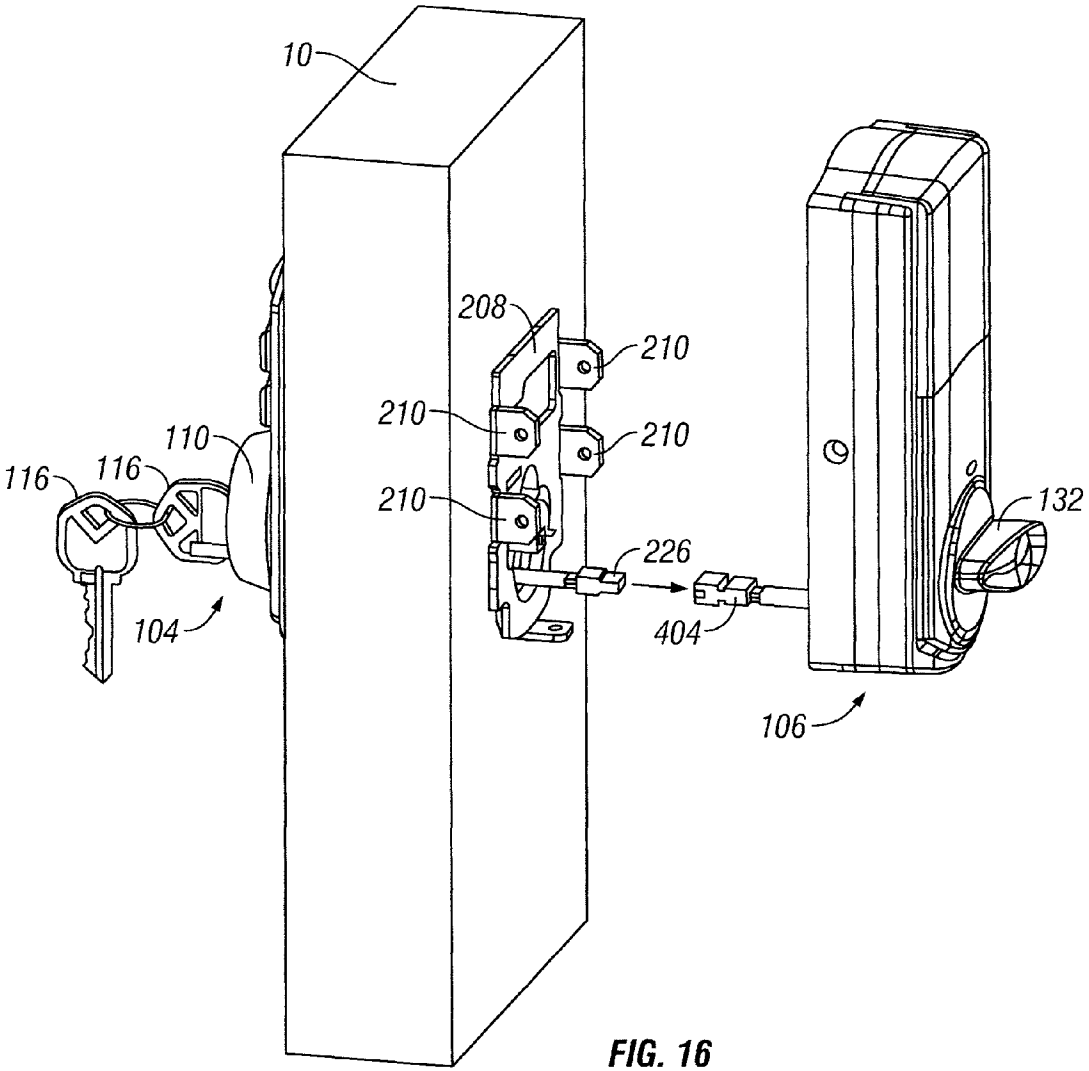

FIGS. 15 and 16 are perspective views showing the deadbolt assembly 100 during installation prior to connection of the exterior connector 226 to the interior connector 404. In the example shown, the exterior connector 226 is a male connector and the interior connector 404 is a female connector. However, this is merely for purposes of example and other types of connectors could be used. As shown, the exterior connector 226 extends through a bore in the door 10 for connection to the interior connector 404. Any excess wiring may be housed within the cavity 506 of the interior assembly 106.

Figure 17:
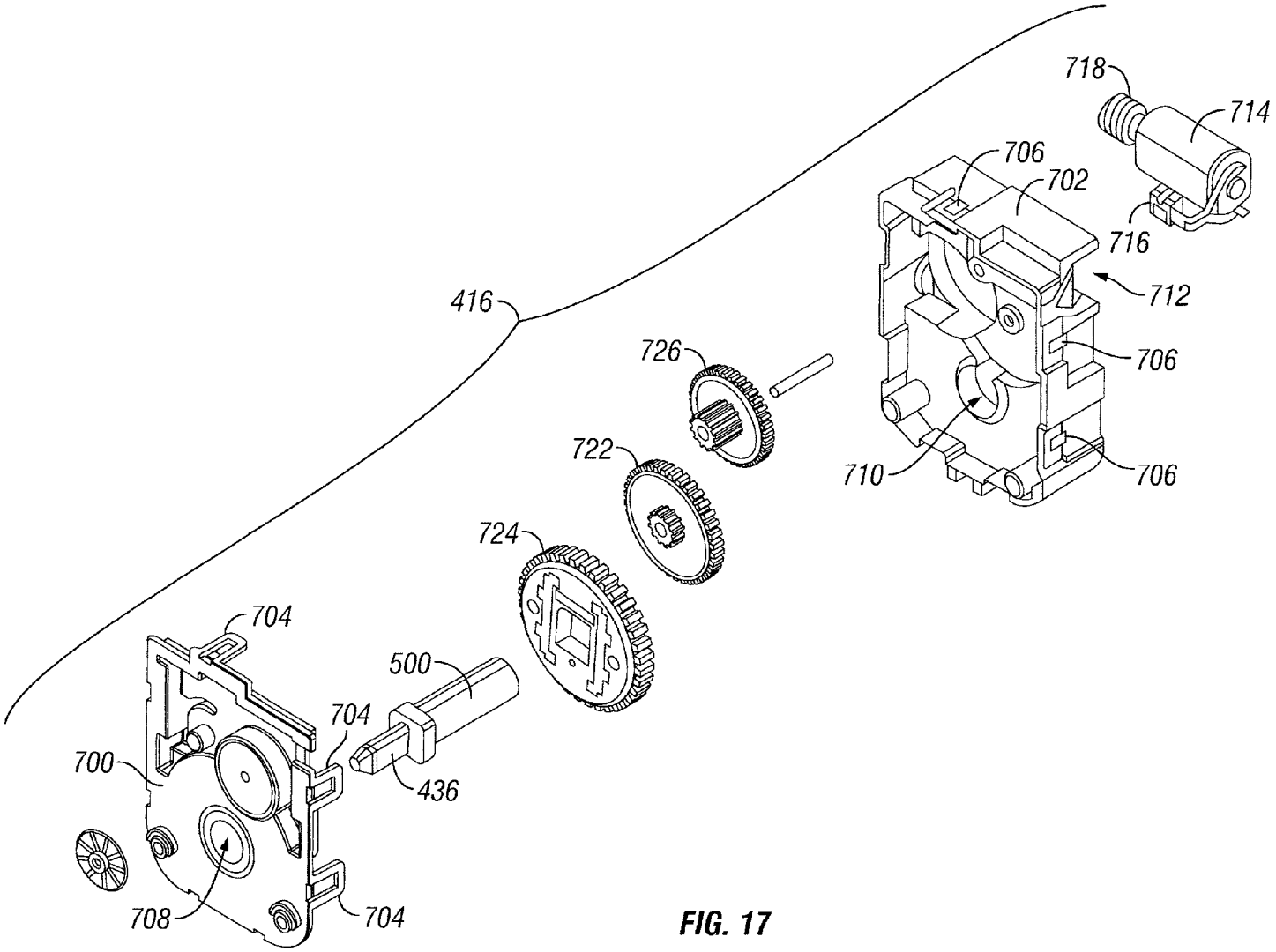
FIG. 17 is an exploded view of the transmission box according to one embodiment.

FIG. 17 is an exploded view of the transmission box 416. In the example shown, the transmission box 416 includes a front cover 700 that connects with a rear cover 702. In the example shown, the front cover 700 includes tabs 704 with openings that receive ridges 706 defined on an exterior surface of the rear cover 702. The front cover 700 includes an opening 708 that corresponds with an opening 710 in the rear cover 702. The opening 708 is dimensioned to receive the stem 436, while the opening 710 in the rear cover 702 is dimensioned to receive the interior driver 500. The rear cover 702 includes a recessed area 712 that is dimensioned to receive a motor 714. The motor includes an electrical connector 716 on one end and a worm shaft 718 on an opposing end. The worm shaft 718 is configured to engage a first gear 720 which engages a second gear 722 that is coupled with a third gear 724. The rotation of the third gear 724 causes rotation of the interior driver 500 and stem 436.

Figure 19:
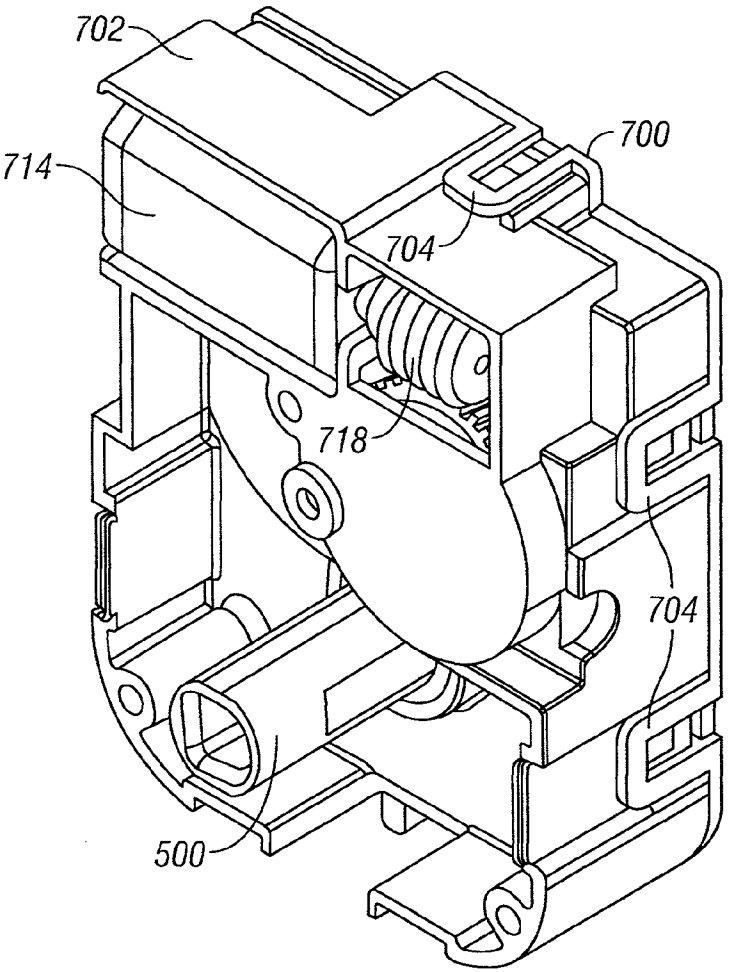
FIG. 19 is a rear perspective view of the transmission box shown in FIG. 17.
Figure 18:
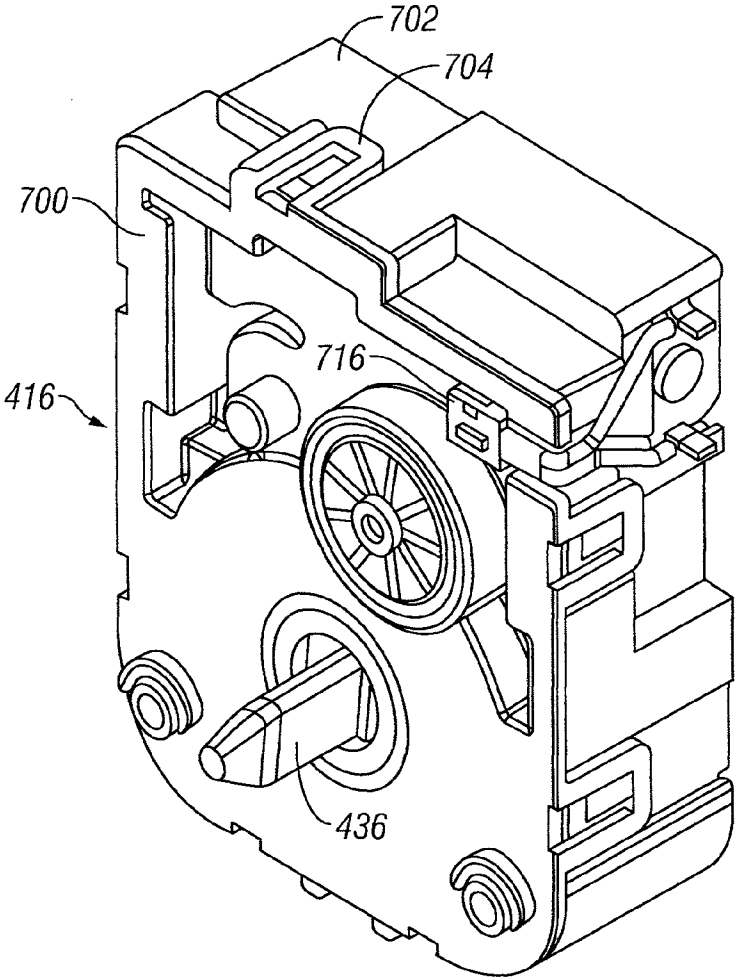
FIG. 18 is a front perspective view of the transmission box shown in FIG. 17.

The motor 714 is in electrical communication with the main board 402 using the electrical connector 716 so that the controller or processor on the main board 402 can control operation of the motor 714. For example, if the controller on the main board 402 received an authorized passcode from a user entering the code using the keypad 111, the controller would actuate the motor 714, which would in turn rotate the interior driver 500. The rotation of the interior driver 500 causes rotation of the torque blade 228, which actuates the spindle drive 218 on the latch assembly 104, thereby retracting or extending the bolt 118. The gear train 720, 722, and 724 uses three gears in this embodiment instead of the typical use of two gears. The use of more than two gears requires less torque, which allows the use of a smaller motor 714, thereby decreasing the package of the transmission box 416. FIGS. 18 and 19 show front and rear perspective views of the transmission box, respectively.

FIGS. 20-26 are flowcharts showing operation of the deadbolt assembly 100 based on user interaction with keypad 111 and/or the programming button 406. In some embodiments, a controller or processor on the main board 402 is programmed with one or more of the operations or processes discussed in the flowcharts.

Figure 20:
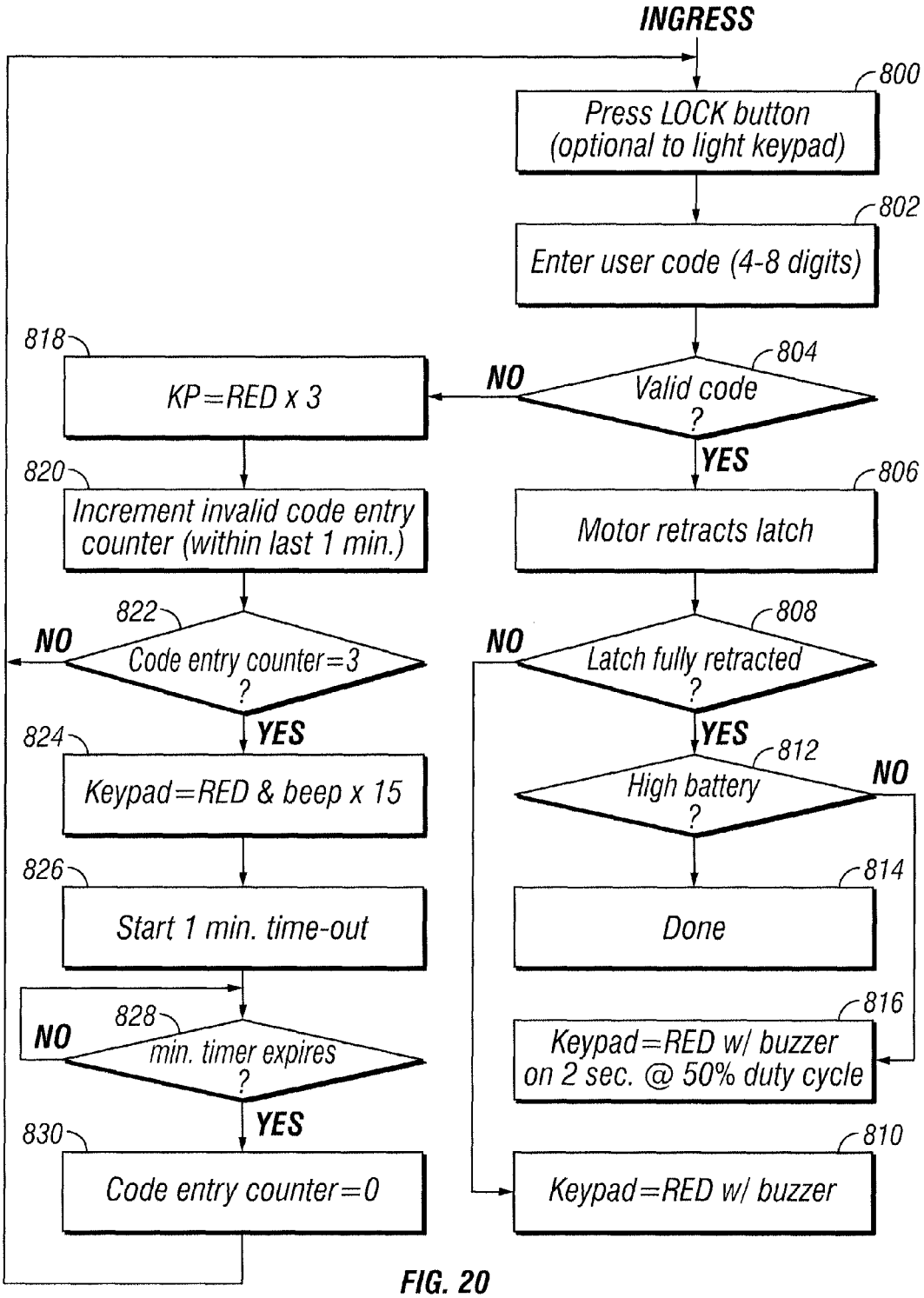
FIGS. 20-26 are flow charts showing possible operations or functions that may be performed by the deadbolt assembly according to one embodiment.

FIG. 20 shows steps that may occur when a user is attempting to enter a secure area (ingress) by unlocking the deadbolt assembly 100. If it is dark outside or in the area in which the exterior assembly 102 is located, the user may press a button on the keypad 111, such as the lock button, to light the keypad (block 800). The user will then enter a passcode or user code by pressing a sequence of buttons 112 on the keypad. (Block 802) If the passcode is valid (block 804), the motor 714 retracts the latch. (Block 806) If the latch does not retract fully (block 808), an error code may be shown to the user, such as by having the keypad turn red and/or an audible buzzer sounding (block 810). If the latch does fully retract, a check is made on the battery level (block 812). If the voltage on the battery is above a predetermined level, the process is done (block 814). If the battery voltage is below a predetermined level, an error message may alert the user that the battery should be replaced, such as by flashing the keypad and/or sounding an audible buzzer (block 816). If the user fails to enter a valid code (block 804), an audible warning may be provided to the user, such as by flashing the keypad red (block 818). A count is kept as to the number of incorrect codes that are entered by the user, which is incremented by one (block 820). If the number of invalid passcodes entered within a certain predetermined time period exceeds a predetermined number, such as three, the user will be alerted that the system has gone into lockout mode (block 824) and has started a timer (block 826). When the timer expires (block 828), the counter is reset (block 830) and the user may try to enter an additional passcodes to unlock the deadbolt assembly.

Figure 21:
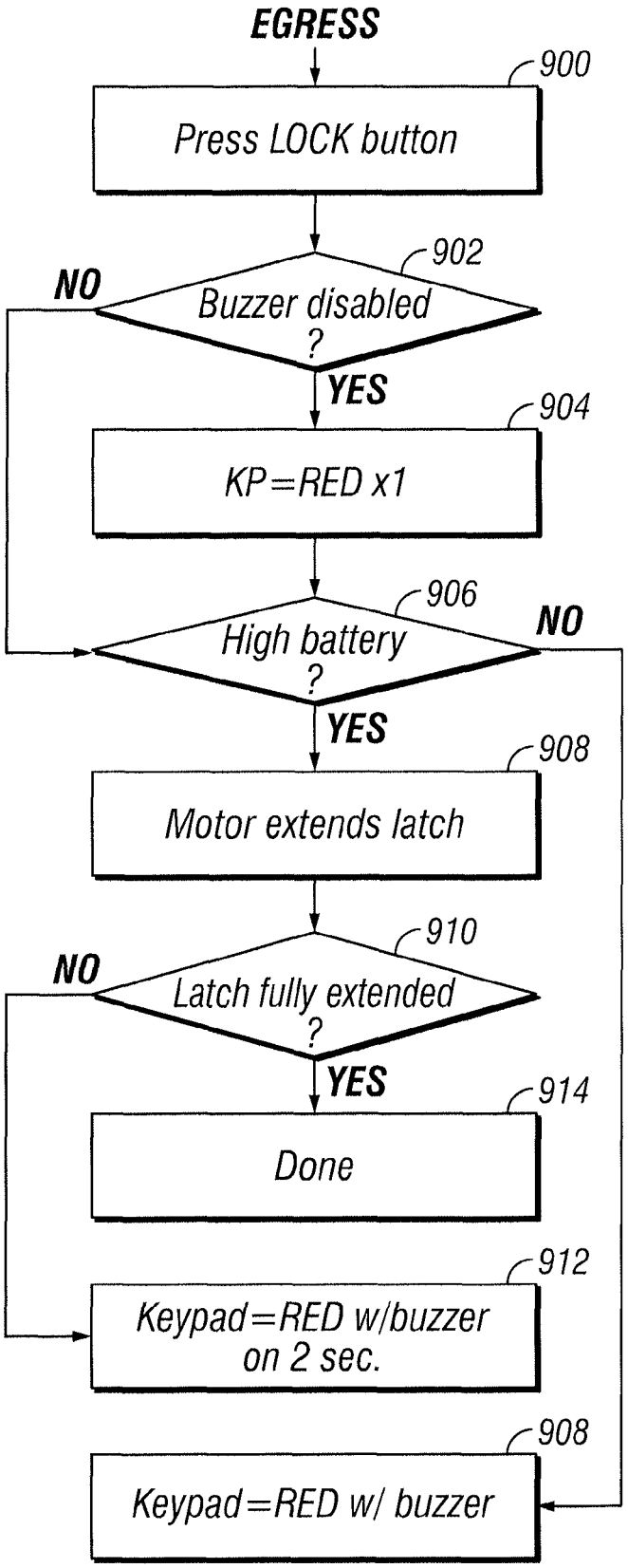

FIG. 21 shows possible steps that may be taken by the controller when a user is attempting to lock the deadbolt assembly 100 using the exterior assembly 102 (egress). In such a circumstance, the user would select the lock button (block 900). If the buzzer is disabled (block 902), the keypad may flash. (Block 904) A check is made to determine whether the voltage of the battery is above a predetermined threshold. (Block 906) If the battery is below the predetermined threshold, the user is alerted that the battery needs to be replaced, such as by flashing the keypad red. (Block 908) Otherwise, the motor 714 extends the latch to lock the deadbolt assembly 100. (Block 908) If the latch does not fully extend (block 910), the user will be alerted by an error message, such as by flashing the keypad red and/or with an audible buzzer (block 912). Otherwise, the deadbolt assembly is locked and the process is done. (Block 914)

Figure 22:
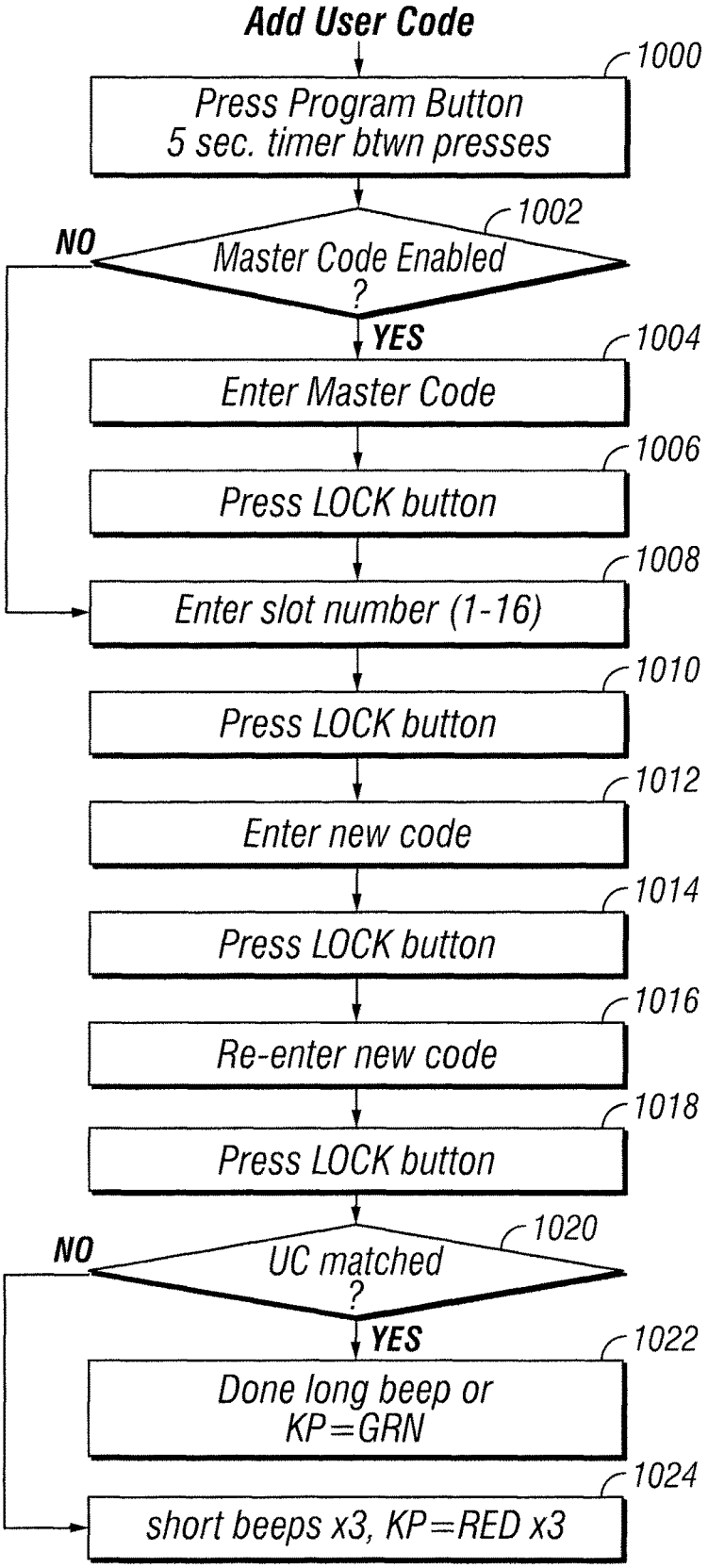

FIG. 22 shows possible steps that may be taken in an embodiment in which the controller is programmed with a master mode. In this example, the user may enter into a mode to add additional user codes by selecting the programming button 406 on the main board 402. (Block 1000) If the master mode is enabled (block 1002) the master code must be entered (block 1004) and the lock button pressed (block 1006). Otherwise, the slot number for the user code may be entered using the keypad (block 1008) and the lock button entered (block 1010). The new user code may then be entered (block 1012) by pressing the lock button (block 1014). For confirmation, the new code must be reentered in this example (block 1016) and then selecting the lock button (block 1018). If the user code matches the code stored in memory (block 1020), the user is notified of this fact, such as by a long beep and/or flashing the keypad a green color (block 1022). If not, the user is notified that the new user code was not added, such as by an audible beep and/or flashing the keypad red (block 1024).

Figure 23:
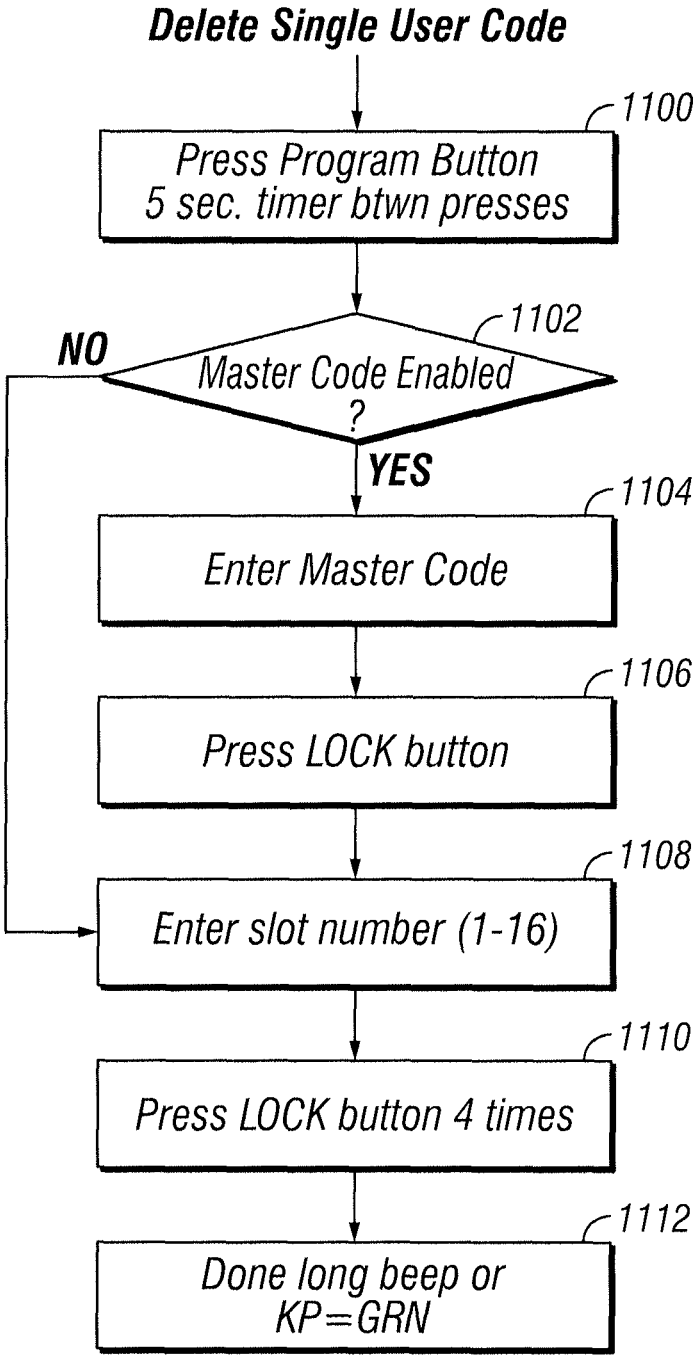

FIG. 23 is a flowchart showing an example process for deleting a single user code. In this example, the user may enter this mode by selecting the programming button 406 for a predetermined length of time (block 1100). If a master mode is enabled (block 1102), the master code must be entered (block 1104) and the lock button entered (block 1106). The slot number of the user code to be deleted is then entered (block 1108) and the lock button pressed a certain number of times in this example (block 1110). The system will acknowledge that the user code has been deleted, such as by a long beep and/or flashing the keypad green (block 1112).

Figure 24:
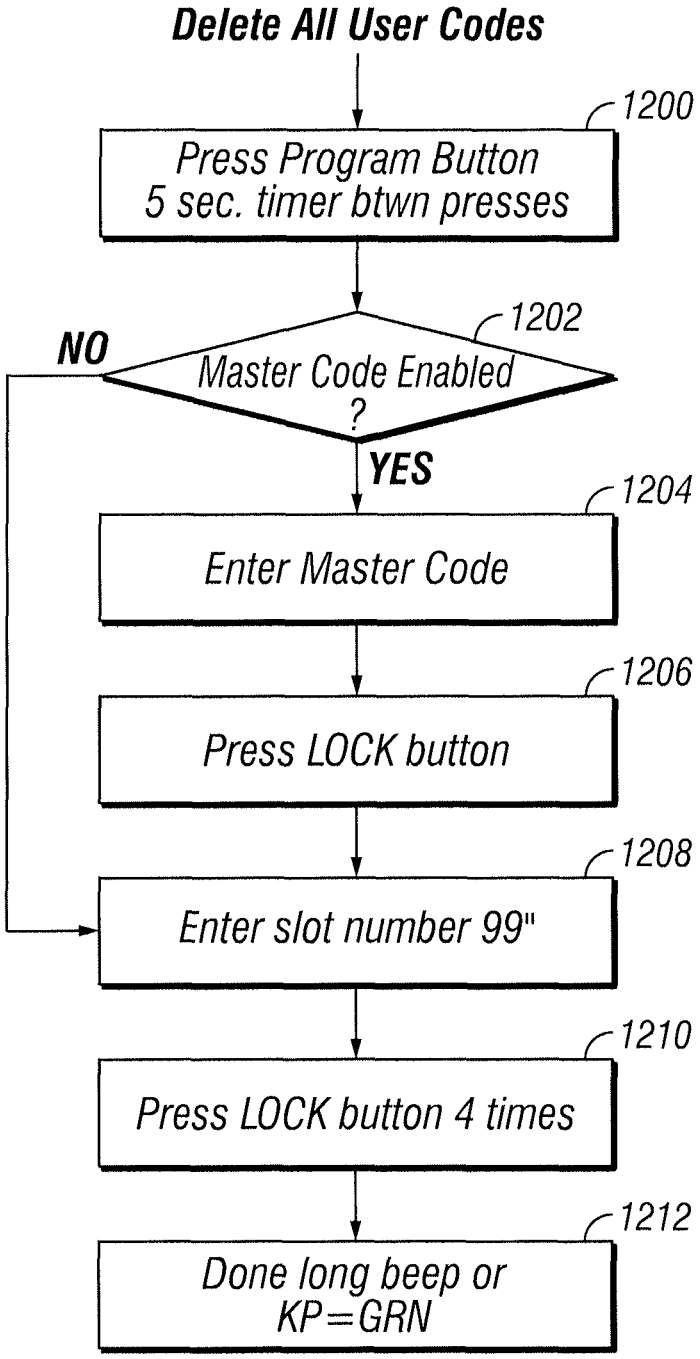

FIG. 24 is a flowchart showing a process by which all user codes can be deleted at one time. One way to enter this mode, for example, could be pressing the programming button 406 for a certain period of time, such as five seconds (block 1200). If the master mode is enabled (block 1202), the master code must be entered (block 1204) and the lock button pressed (block 1206). The slot number to delete all user codes could be a unique number or key sequence, such as "99." (Block 1208) After pressing the lock button a predetermined number of times, such as four times (block 1210), the system may acknowledge that all user codes have been deleted, such as by audibly making a long beep and/or flashing the keypad a green color (block 1212).

Figure 25:
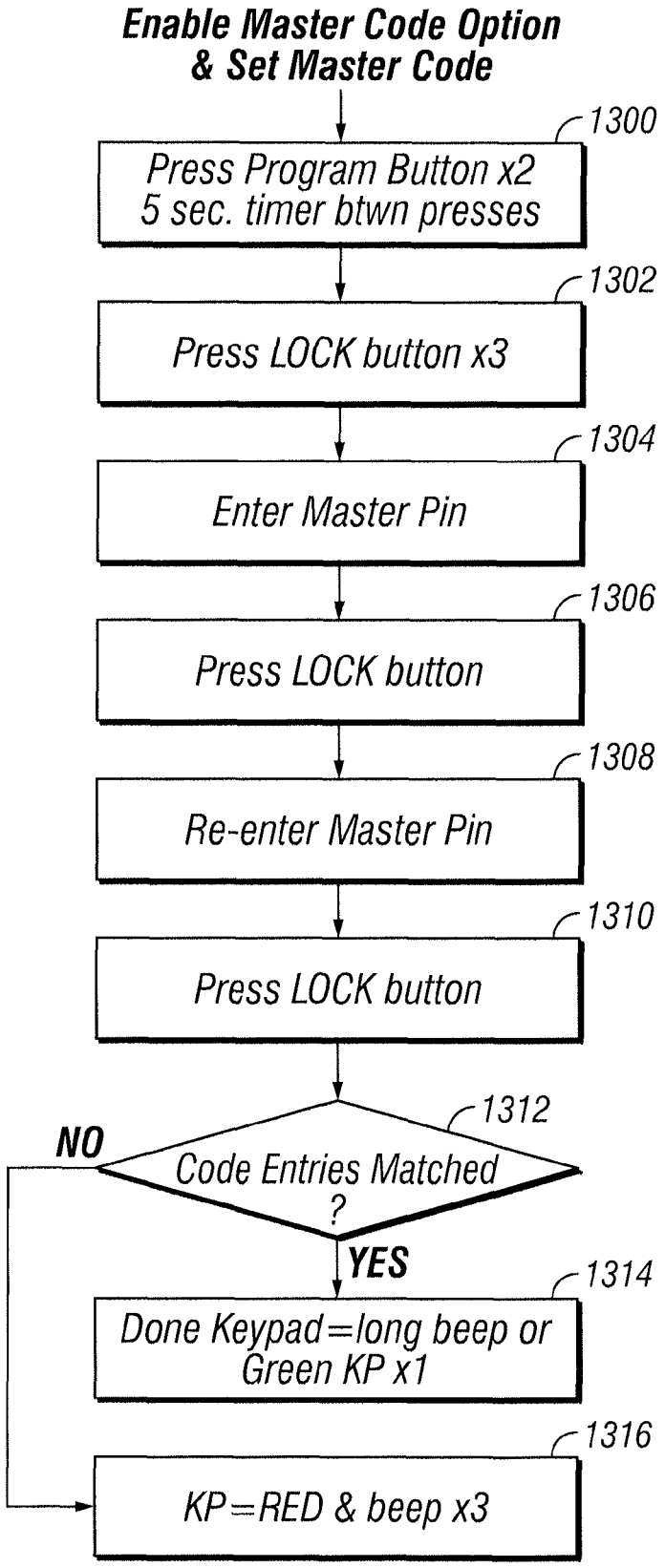

FIG. 25 shows an example process by which the master mode option can be enabled and the master code set. In this example, entering this mode may be made by pressing the programming button 406 multiple times for a certain period of time (block 1300). In this example, the next step is pressing the lock button a certain number of times, such as three times (block 1302). A master pin may then be entered (block 1304) and the lock button pressed (block 1306). For confirmation, the user may reenter the master pin (block 1308) and then press the lock button (block 1310). If this code matches (block 1312), the user is notified that the master code has been set, such as with a long beep and/or flashing the keypad green (block 1314). Otherwise, the user is notified that the master mode has not been enabled, such as with an audible beep and/or flashing the keypad red (block 1316).

Figure 26:
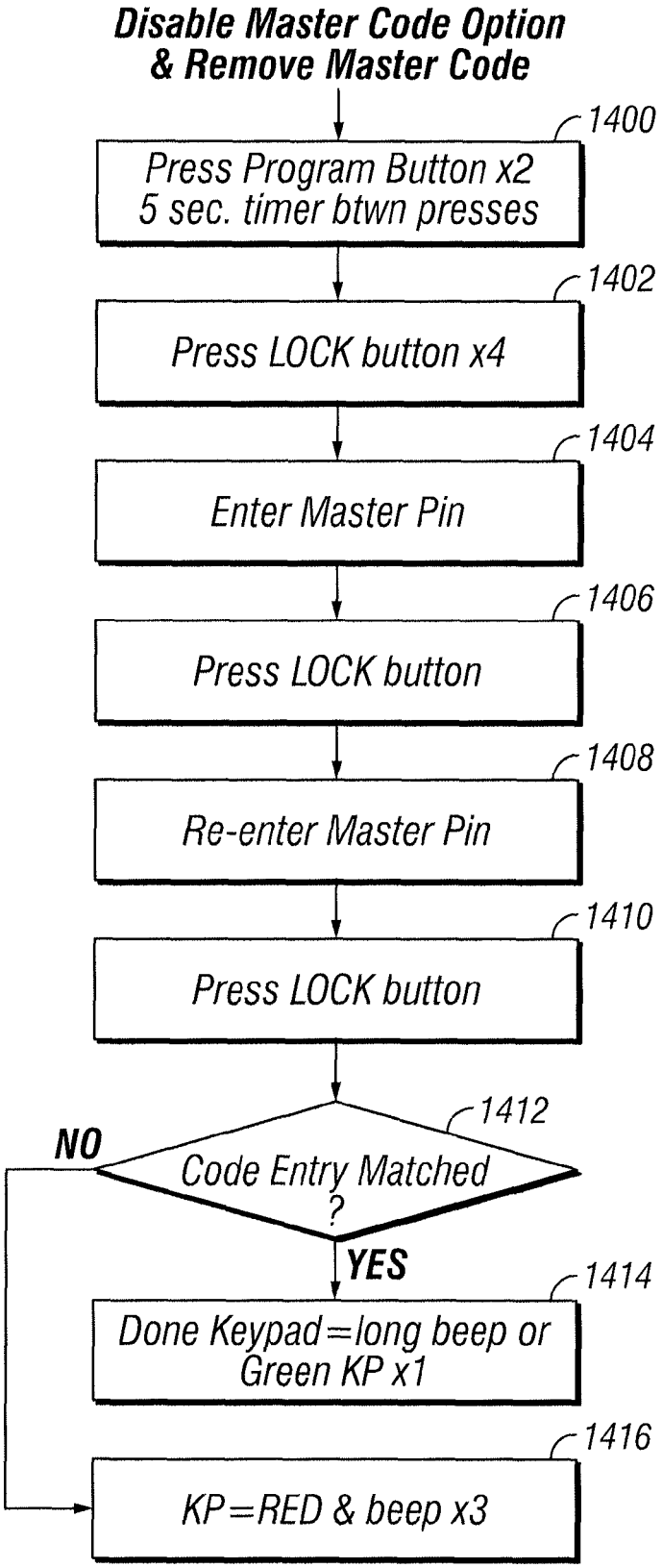

FIG. 26 shows example steps for disabling the master code option and removing the master code. In the example shown, the process starts by pressing the programming button 406 a certain number of times for a certain period of time (block 1400) and then pressing the lock button a certain number of times (block 1402). The system requires the master pin to be entered (block 1404) and entered by pressing the lock button (block 1406). Confirmation of the master pin is required (block 1408) and by selecting the lock button (block 1410). If the code matches (block 1412), the user is notified that the master code option has been disabled, such as by a long beep and/or flashing the keypad a green color. Otherwise, the user is notified that the system was unable to disable the master code option, such as by an audible beep and/or flashing the keypad red (block 1416).

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An electronic deadbolt assembly comprising:

a latch assembly with a bolt movable between an extended position and a retracted position;

a motor operably connected to the latch assembly and configured to move the bolt between the extended position and the retracted position;

an exterior assembly including an electronic input device for entering a passcode, wherein the exterior assembly includes a wiring harness in electrical communication with the electronic input device;

an interior assembly including a circuit board with a controller configured to control actuation of the motor to move the bolt between the extended position and the retracted position responsive to receiving an authorized passcode from the electronic input device;

wherein the controller is in electrical communication with the electronic input device by an electrical connection between the wiring harness and an interior connector extending from the circuit board;

wherein the interior connector includes a first end connected to the circuit board with a wire and a second end extending from the circuit board and configured to connect with the wiring harness;

wherein the interior connector extends out of the interior assembly; and wherein the interior connector is movable with respect to the circuit board about the wire;

wherein the interior assembly includes a back plate defining an opening through which the interior connector extends; and wherein the circuit board includes a first side and an opposing second side, wherein the interior connector is connected to a first side of the circuit board and extends from the second side through the opening in the back plate.

2. The electronic deadbolt assembly as recited in claim 1, wherein the interior assembly includes a cavity defined between the back plate and the circuit board that is dimensioned to receive at least a portion of the wiring harness.

3. An electronic deadbolt assembly comprising:

a latch assembly with a bolt movable between an extended position and a retracted position;

an exterior assembly including an electronic input device for entering a passcode;

an interior assembly including a controller in electrical communication with the electronic input device using a wiring harness, wherein the controller is configured to control movement of the bolt between the extended position and the retracted position responsive to receiving an authorized passcode from the electronic input device, wherein the interior assembly defines a longitudinal axis;

an interior cover housing the interior assembly;

a turnpiece extending through an opening of the interior cover;

a stem connected to both the turnpiece and an interior driver, the stem dimensioned to receive the turnpiece, wherein the interior driver is operably connected with the latch assembly; and a mounting bracket including a plate portion defining a pass-through dimensioned to receive the wiring harness and a plurality of spaced-apart tabs extending transversely from the longitudinal axis of the interior assembly, wherein the interior assembly includes threaded openings correspondingly positioned with openings in the plurality of tabs for connecting the interior assembly to the mounting bracket, and wherein at least a portion of the tabs are spaced apart on opposing sides of the longitudinal axis of the interior assembly.

4. The electronic deadbolt assembly as recited in claim 3, wherein the interior assembly further comprises a back plate and an interior cover dimensioned to receive the back plate.

5. The electronic deadbolt assembly as recited in claim 4, wherein at least a portion of the plurality of tabs extend between the back plate and the interior cover.

6. The electronic deadbolt assembly as recited in claim 5, wherein the interior cover includes a plurality of threaded openings alignable with the tabs in the mounting bracket.

7. The electronic deadbolt assembly as recited in claim 6, wherein a portion of fasteners extend through the interior cover, tabs and back plate.

8. The electronic deadbolt assembly as recited in claim 3, wherein the stem has a generally triangular shaped cross-section.

9. The electronic deadbolt assembly as recited in claim 3, wherein the interior assembly includes a transmission with a gear train having more than two gears.

10. The electronic deadbolt assembly as recited in claim 9, wherein the gear train includes three gears, wherein one of the three gears operably connected with the latch assembly.

11. An electronic deadbolt comprising:

a latch assembly including a bolt movable between an extended position and a retracted position;

an exterior assembly including an electronic input device configured to receive an input data, wherein the exterior assembly includes a wiring harness in electrical communication with the electronic input device;

a motor configured to move the bolt between the extended and retracted positions;

an interior assembly including a circuit board with a controller configured to control actuation of the motor responsive to input data received from the electronic input device, wherein the controller is switchable between:

a single user mode in which the controller actuates the motor responsive to an authenticated user code;

a master mode in which the controller actuates the motor responsive to an authenticated master code and an authenticated user code;

wherein in the master mode, the controller is configured to add an additional authenticated user code responsive to input data received from the electronic input device;

wherein the controller is in electrical communication with the electronic input device by an electrical connection between the wiring harness and an interior connector extending from the circuit board;

wherein the interior assembly includes a back plate defining an opening through which the interior connector extends; and wherein the circuit board includes a first side and an opposing second side, wherein the interior connector is connected to a first side of the circuit board and extends from the second side through the opening in the back plate.

12. The electronic deadbolt as recited in claim 11, wherein the controller is configured to switch between the master mode and the single user mode responsive to input data received from the electronic input device.

13. The electronic deadbolt as recited in claim 11, wherein in the master mode, the controller is configured to delete an authenticated user code responsive to input data received from the electronic input device.

14. The electronic deadbolt as recited in claim 11, wherein in the single user mode, the controller is configured to prohibit adding additional authenticated user codes.

15. The electronic deadbolt assembly as recited in claim 1, wherein the interior connector is movable with respect to the wiring harness about the wire.

* * * * *